United States Patent [19]

Imatani et al.

[11] Patent Number: 4,536,243

[45] Date of Patent: Aug. 20, 1985

[54] METHOD AND APPARATUS FOR MAKING A METAL CAN

[75] Inventors: Tsuneo Imatani, Yokosuka; Hisakazu Yasumuro; Michio Watanabe, both of Yokohama; Hideo Kurashima, Yokosuka; Kazuhisa Ishibashi, Tokyo, all of Japan

[73] Assignee: Toyo Seikan Kaisha, Ltd., Tokyo, Japan

[21] Appl. No.: 552,057

[22] PCT Filed: Mar. 8, 1983

[86] PCT No.: PCT/JP83/00072

§ 371 Date: Nov. 2, 1983

§ 102(e) Date: Nov. 2, 1983

[87] PCT Pub. No.: WO83/03066

PCT Pub. Date: Sep. 15, 1983

[30] Foreign Application Priority Data

| | | | |
|---|---|---|---|
| Mar. 8, 1982 | [JP] | Japan | 57-35181 |
| Mar. 19, 1982 | [JP] | Japan | 57-42521 |
| Apr. 6, 1982 | [JP] | Japan | 57-56069 |

[51] Int. Cl.[3] ..... B29C 19/04

[52] U.S. Cl. ..... 156/274.6; 156/274.8; 156/275.3; 156/294; 413/1; 413/69

[58] Field of Search ..... 156/294, 295, 274.6, 156/274.8, 274.4, 275.3, 275.5, 272.4; 413/1, 69

[56] References Cited

U.S. PATENT DOCUMENTS 4,451,316 5/1984 Ishibashi ..... 413/1

FOREIGN PATENT DOCUMENTS 47737 1/1973 Japan .

57-28641 2/1982 Japan .

*Primary Examiner*—Leon Gilden

*Attorney, Agent, or Firm*—Stevens, Davis, Miller & Mosher

[57] ABSTRACT

A method of, and apparatus for, manufacturing a metal can (1) with an annular seam (5) which is capable of withstanding high internal pressures and resisting chemical action. A piece of thermoplastic tape is heat bonded to the outer surface (10$a_3$) of the open end portion (10*a*) of a first can section (10) so as to leave a portion (11*a*) projecting therefrom. After being bent radially inwardly of the first can section, the projecting tape portion is further folded back into forced contact with the inner surface (10$a_2$) of the open end portion of the first can section by means of a mandrel (16). The open end portion of the first can section is then heated, with the fold of the tape held pressed against its inner surface by the mandrel, to cause adhesion of the thermoplastic tape to the outer surface, edge (10$a_1$), and inner surface of the open end portion of the first can section. An adhesive layer (4) is thus provided. This open end portion of the first can section is then press-fitted in the open end portion (2*a*) of a second can section (2), and the joint (44) therebetween is heated to cause adhesion of the lapping open end portions of the can sections to each other via the adhesive layer.

10 Claims, 23 Drawing Figures

METHOD AND APPARATUS FOR MAKING A METAL CAN

TECHNICAL FIELD

The present invention relates to a method of, and apparatus for, the manufacture of a metal-made can capable of withstanding high internal pressures, which is formed by interfitting the open ends of upper and lower can sections via an adhesive layer and then by thermally melting the adhesive layer to provide an annular seam joining the can sections.

BACKGROUND ART

Japanese Patent Laid-Open (Kokai) Nos. 54-49611, 56-32228, and 55-38294 suggest pressure-proof, relatively thin-walled metal-made cans particularly well suited for containing beer, carbonated soft drinks, etc., with capacities usually ranging from about one to 10 liters. These known metal cans are each comprised of upper and lower seamless can sections having open ends, one of which is reduced in diameter and which are fitted together via an adhesive layer. The subsequent bonding of the interfitting end portions of the can sections provides an annular lap seam.

Drawing is the usual technique employed for producing the upper and lower sections of such metal cans. They must be proof against the chemical attack of the contents. Thus the blanks to be drawn have corrosion-proof coatings (e.g., phenol epoxy coating or organosol) applied on their surfaces which are to become the inner surfaces of completed cans. However, although the inner surfaces of the cans are thus protected against corrosion, the metal is left exposed to the contents at the edges of the underlapping end portions of the can sections as these edges are formed by severance. In order to assure sufficient proofness of the metal cans against corrosion by the contents, the underlapping edge as well as neighboring inside surface portions should be covered with an adhesive layer.

Such adhesive layers may be provided by the application of a coating of liquid adhesive, such as that in the form of slurry, or thermosetting adhesive, as disclosed in Japanese Patent Laid-Open (Kokai) No. 55-153629, or by the electrostatic coating using a powdered adhesive. A preferred method is to thermally fuse a length of thermoplastic tape onto the outer surface of the open end portion of one of the constituent sections of each can in such a way that part of the tape projects beyond the edge of the can section. Then the projecting tape portion is folded over and thermally fused onto the edge and inner surface of the can section. Then the other can section is engaged with the adhesivetreated can section and is heat sealed thereto. This method will provide an adhesive layer of constant thickness, free from entrapped air or other defects, between the lapping ends of the can sections.

In the practice of the above preferred method, the use of a forced stream of heated air may be contemplated for melting or softening the projecting portion of the thermoplastic tape in attaching it to the edge and neighboring inner surface portion of one of the can sections. The use of heated air is not recommended, however, because the tape might become unduly thin at its bent portions or might be torn, thus failing to perform the corrosionproofing function to the full. An alternative method readily conceived may be the use of a roll or brush, thereby to fold the projecting tape portion inwardly preparatory to thermally fusing it. This alternative method is also objectionable as the folding of the tape over the heated can section would cause the tape to become thin at its bent portions, or torn or wrinkled, or to entrap air. Here again, no satisfactory results would be obtained.

Accordingly, an object of the present invention is to provide a method of, and apparatus for, the manufacture of a metal can having an annular seam, such that the projecting portion of the plastic tape that has been thermally fused onto the outer surface of the open end portion of one of the can sections can be thermally fused onto the edge and adjacent inner surface portion of the can section without tears or wrinkles, without thinning at the bent portions, or without air entrapment.

Another object of the invention is to provide apparatus for the manufacture of a metal can having an annular seam, which comprises means for automatically and positively heat-sealing a length of plastic tape onto the outer surface of the open end portion of one of the can sections so as to leave part of the tape projecting therefrom, without giving rise to defects such as wrinkles or nonadhering portions.

The can section that has had the adhesive layer formed on its open end portion as above is then fitted in the open end of the other can section. Then heat is applied to melt the adhesive layer and so to fuse the open ends of the can sections to each other into an annular seam. In order to make this seam sufficiently airtight, the can sections should be heat sealed to each other under pressure.

For pressure application for the above purpose, Japanese Patent Laid-Open Nos. 56-32228 and 57-28643 propose to insert the open end of one can section into that of the other can section while the latter is heated and expanded in diameter, and then to allow the outer end to cool and shrink into tight fit with the inner end. This method requires an added step of thermally expanding the open end portion of one of the can sections. Another difficulty is the delicate temperature control necessitated to cause the can sections to fit together under a required degree of pressure.

According to another solution suggested by Japanese Patent Laid-Open No. 55-153629, the open end of one can section is forced into that of the other can section which is supported in a die. The subsequent springback of the inserted can section produces the pressure required for its tight fit with the other can section.

A problem arises in connection with this solution in the case where the can section to be pressfitted in the other is generally of thin wall. Particularly if the can section is made of material of relatively low rigidity, such as aluminum or its alloy, then its open end portion is easy to buckle circumferentially on reduction in diameter at the time of the forced insertion into the other can section. The buckling of the can section provides passages intercommunicating the interior and exterior of the completed can, to the detriment of the required air- and liquid-tightness of the seam.

It is therefore a further object of this invention to provide a method of, and apparatus for, the manufacture of a metal can having an annular seam, comprising a step of, and means for, interfitting the open ends of the can sections under sufficient pressure without the need for any such complex step as the thermal expansion of one can section or without the possibility of buckling the end of one can section engaged in that of the other.

DISCLOSURE OF INVENTION

The present invention provides a method of making a metal can having an annular seam formed by joining the open end portions of first and second can sections via an adhesive layer, characterized by the steps of reducing the diameter of the open end portion of the first can section to provide a reduced diameter portion having an outside diameter substantially equal to the inside diameter of the open end portion of the second can section, heat bonding a piece of thermoplastic tape onto the outer surface of the reduced diameter portion of the first can section so as to leave a portion projecting therefrom, folding the projecting portion of the tape substantially radially inwardly of the first can section to cause part of the projecting tape portion to come into contact with the edge of the open end portion of the first can section, further folding the rest of the projecting tape portion into forced contact with the inner surface of the open end portion of the first can section by inserting a mandrel thereinto, causing thermal adhesion of the tape to the edge and inner surface of the open end portion of the first can section by heating the open end portion of the first can section to more than a temperature at which the tape is fusible, while part of the tape is held pressed against the inner surface of the open end portion of the first can section, inserting the reduced diameter portion of the first can section into the open end portion of the second can section, and causing thermal adhesion of that part of the tape which overlies the outer surface of the reduced diameter portion of the first can section to the inner surface of the open end portion of the second can section to form the annular seam by heating at least the open end portion of the second can section.

The invention also provides apparatus for the manufacture of a metal can having an annular seam formed by joining the open end portions of first and second can sections via an adhesive layer, characterized by means for heat bonding a piece of heat-sealable plastic tape onto the outer surface of the open end portion of the first can section so as to leave a portion projecting therefrom, the open end portion of the first can section being reduced in diameter and having an outside diameter substantially equal to the inside diameter of the open end portion of the second can section; means for heat bonding the projecting portion of the plastic tape to the edge and inner surface of the reduced diameter open end portion of the first can section, comprising a die having a first cavity for closely receiving the reduced diameter open end portion of the first can section together with the plastic tape heat bonded thereto, an annular shoulder extending radially inwardly from the first cavity and having a width substantially equal to the sum of the wall thickness of the open end portion of the first can section and the thickness of the plastic tape, and a second cavity disposed opposite to the first cavity across the annular shoulder in concentric relationship thereto and having an inside diameter greater than the inside diameter of the open end portion of the first can section, a mandrel to be inserted into and through the second cavity in the die for pressing the projecting portion of the plastic tape against the inner surface of the open end portion of the first can section received in the first cavity in the die, the mandrel having a maximum diameter greater than the remainder of the inside diameter of the open end portion of the first can section minus twice the thickness of the plastic tape, and means for heating the open end portion of the first can section while the projecting portion of the plastic tape is pressed against the inner surface thereof; means for inserting the reduced diameter portion of the first can section, with the plastic tape heat bonded to the outer and inner surfaces and edge thereof, into the open end portion of the second can section; and means for heating at least the open end portion of the second can section having the reduced diameter portion of the first can section inserted therein, in order to cause heat bonding of that part of the plastic tape which overlies the outer surface of the reduced diameter portion of the first can section to the inner surface of the open end portion of the second can section.

The above method and apparatus make possible the provision of a metal can having a highly corrosionproof annular seam, with the adhesive layer on the edge and inner surface of the open end portion of the first can section having no such defects as thinning, tears, wrinkles, or air entrapment.

The invention further provides apparatus for the manufacture of a metal can with an annular seam wherein the means for heat bonding the plastic tape to the outer surface of the open end portion of the first can section comprises plastic tape piece supply roll means, adhesion roll means having an adhesion roll to be rotated continuously, can section transport means for successively transporting first can sections to a position opposite to the adhesion roll and for holding each first can section in the position opposite to the adhesion roll during the heat bonding of a tape piece thereto, mandrel means to be engaged in the reduced diameter open end portions of the successive first can sections, means for heating the reduced diameter open end portions of the first can sections to a temperature permitting the adhesion of the plastic tape thereto by the time the first can sections reach the position opposite to the adhesion roll, and means for revolving each first can section so that the reduced diameter open end portion thereof rotates at a prescribed peripheral speed during the heat bonding of the plastic tape thereto, the tape piece supply roll means comprising a supply roll having formed therein suction ports for holding by suction the plastic tape wrapped around the same after being fed from payoff means, a cutter for cutting the plastic tape into successive pieces each having a length approximately equal to the circumference of the reduced diameter open end portion of each first can section, and drive means for the supply roll, the adhesion roll of the adhesion roll means having a tape applying surface of heat-resistant elastic rubber for heat bonding the pieces of plastic tape to the outer surfaces of the reduced diameter open end portions of the successive first can sections in coaction with the mandrel means, the tape applying surface of the adhesion roll having formed therein suction ports for holding by suction the successive pieces of plastic tape supplied from the tape piece supply roll means, the tape applying surface of the adhesion roll having a circumferential dimension equal to, or slightly longer than, the length of each piece of plastic tape and having a peripheral speed equal to the peripheral speed of the reduced diameter open end portion of each first can section.

The above means make it possible to automatically and positively fuse plastic tape onto the outer surfaces of the open end portions of successive first can sections so as to partly project therefrom, without giving rise to defects such as wrinkles or nonadhering portions.

According to a further aspect of the invention, a split tool is used for the insertion of the reduced diameter open end portion of the first can section, together with the thermoplastic tape heat bonded thereto, in the open end portion of the second can section. The split tool comprises a first cavity having a cylindrical guide surface in which the open end portion of the second can section can be fitted, an annular shoulder extending radially inwardly from the inner end of the cylindrical guide surface and having a width equal to, or slightly more than, the wall thickness of the open end portion of the second can section, and a second cavity disposed opposite to the first cavity across the annular shoulder in concentric relationship thereto and having a frustoconical guide surface adjoining the annular shoulder and increasing in diameter as it extends away therefrom. The open end portion of the second can section is first fitted in the first cavity of the split tool into abutment against the annular shoulder while the tool is tightened. Then the reduced diameter open end portion of the first can section is forced into and through the second cavity of the split tool to cause further reduction in its diameter by the frustoconical guide surface, until a tip of the reduced diameter open end portion of the first can section becomes engaged in the open end portion of the second can section. Then, after loosening the split tool, the reduced diameter open end portion of the first can section is driven fully into the open end portion of the second can section.

An additional aspect of the invention also concerns the means for the insertion of the reduced diameter open end portion of the first can section, together with the thermoplastic tape heat bonded thereto, in the open end portion of the second can section, which comprise a pair of dies and means for moving the dies toward and away from each other. The pair of dies when closed have a first cavity having a cylindrical guide surface in which the open end portion of the second can section can be fitted, an annular shoulder extending radially inwardly from the cylindrical guide surface and having a width equal to, or slightly more than, the wall thickness of the open end portion of the second can section, and a second cavity having a frustoconical guide surface for guiding the reduced diameter open end portion of the first can section, the second cavity being disposed opposite to the first cavity across the annular shoulder in concentric relationship thereto and substantially adjoining the annular shoulder and increasing in diameter as it extends away from the annular shoulder. The means for moving the dies toward and away from each other include resilient means for tightening the dies and for holding the same completely closed in the initial stage of the insertion of the reduced diameter open end portion of the first can section in the open end portion of the second can section. The elastic modulus of the resilient means is such that the dies are movable apart from each other against the force of the resilient means from the end of the initial stage to the full insertion of the reduced diameter open end portion of the first can section in the open end portion of the second can section.

By use of the above means the open end portions of the two can sections can be interengaged under sufficient pressure to provide an airtight annular seam, without the possibility of the buckling of the underlapping one of the open end portions even if it is relatively thin-walled and low in rigidity.

BEST MODE OF CARRYING OUT THE INVENTION

The present invention will now be described in greater detail with reference to the accompanying drawings.

Figure 1:
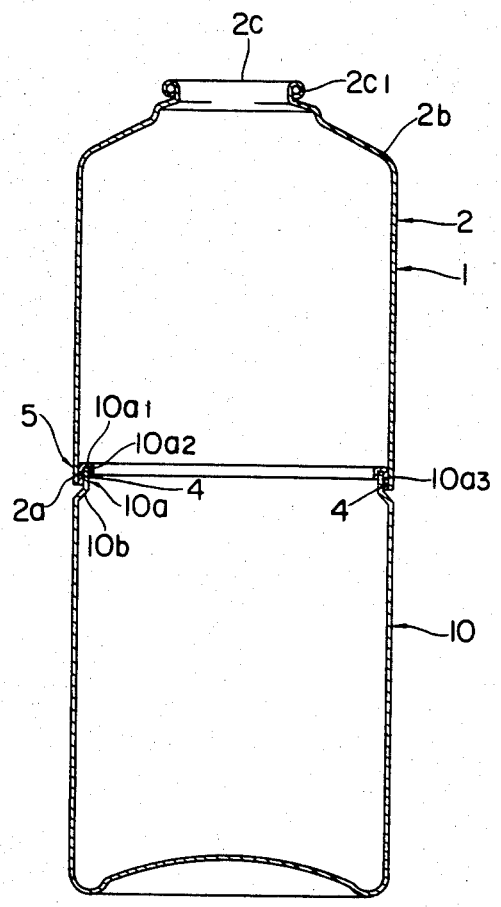
FIG. 1 is a longitudinal section through an example of metal can fabricated in accordance with the invention.

The reference numeral 1 in FIG. 1 generally designates an example of metal can fabricated in accordance with the invention. It comprises a bottomed, cuplike, seamless lower can section 10 having an open end portion 10*a* of reduced diameter, and a seamless upper can section 2 having an open end 2*a*, a shoulder 2*b*, and a narrow mouth 2*c* curled at $2c_1$. The reduced diameter open end portion 10*a* of the lower can section 10 is fitted in the open end 2*a* of the upper can section 2 via an adhesive layer 4, and these interfitting ends are heat bonded to each other to provide an annular lap seam 5. Prior to the creation of the reduced diameter portion the open end portion of the lower can section 10 has an outside diameter and wall thickness substantially equal to the outside diameter and wall thickness of the open end portion of the upper can section 2. On reduction in diameter the open end portion 10*a* of the lower can section 10 has an outside diameter approximately equal to the inside diameter of the open end 2*a* of the upper can section 2. The reduced diameter open end portion 10*a* of the lower can section 10 is connected to the main body of the can section via an annular shoulder 10*b*. Generally the width of this reduced diameter portion can be from about two to 10 millimeters.

The adhesive layer 4 covers the edge or end face $10a_1$ (usually formed by severance) of the open end portion 10*a* and the adjacent parts $10a_2$ and $10a_3$ of its inner and outer surfaces. The adhesive layer 4 is of thermoplastic material. The two can sections are joined together by fitting the reduced diameter open end portion 10*a* of the lower can section in the open end 2*a* of the upper can section.

Although not illustrated, corrosionproof coatings (preferably allowing favorable thermal bondage of plastic tape 11 yet to be described) are applied to the inside surfaces of the upper can section 2 and lower can section 10. A prime coat (not shown) capable of firm thermal bondage to the plastic tape 11 may be formed on the outer surface portion $10a_3$ of the open end portion 10*a*, in particular, as required. Thus the adhesive layer 4 covers the edge $10a_1$, through which the metal has been exposed, and so protects the same against corrosion by the matter to be filled in the can.

The upper can section 2 and lower can section 10 are both fabricated by the drawing, with or without subsequent squeezing, of thin sheet metal blanks such as those of tinned sheet steel (tin plate), tin-free steel (sheet steel electrolytically treated with chromic acid), or aluminum or its alloy. The thickness of the can sections at or adjacent their open ends 2*a* and 10*a* is normally set in the range from about 0.12 to 0.3 millimeter for the economy of the material. Generally the thickness is of the minimum allowable in consideration of the required strength of the completed cans, which depends upon their applications.

Described hereinbelow is a method of, and means for, applying the adhesive layer 4 of thermoplastic material to the edge 10*a* and adjoining inner and outer surface portions $10a_2$ and $10a_3$ of the open end portion 10*a* of the lower can section 10.

Figure 2:
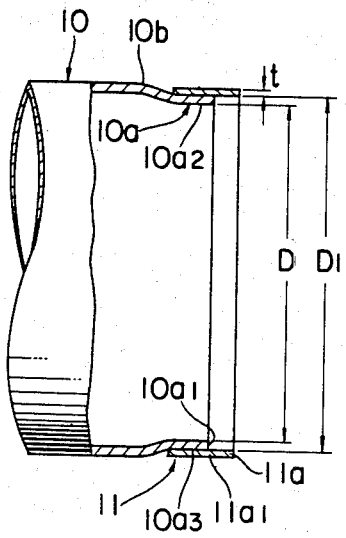
FIG. 2 is a fragmentary longitudinal section through the lower section of the metal can of FIG. 1, shown together with a piece of plastic tape thermally attached to the outer surface of the open end portion of the lower can section preparatory to the creation of an adhesive layer thereon.

In FIG. 2 is shown a piece of plastic tape 11 (usually from about 30 to 150 micronmeters in thickness) heat bonded to the annular outer surface $10a_3$ of the open end portion 10*a* of the lower can section 10. The plastic tape 11 partly projects beyond the edge $10a_1$ of the open end portion to provide a projecting tape portion 11*a*. The plastic tape 11 is of thermoplastic material. Examples are denatured linear polyester, nylon 11 or 12, acid-denatured polyolefin, or like thermoplastics having a comparatively low melting or softening point and having polar radicals.

For the best results, for the thermal adhesion of the plastic tape 11 to the outer surface $10a_3$ of the open end portion 10*a* of the lower can section, a piece of the plastic tape having approximately the same length as the circumference of the outer surface $10a_3$ is held by suction around an adhesion roll. The open end portion 10*a* of the lower can section is internally supported by a mandrel and heated to a temperature enabling the adhesion of the plastic tape 11. While the adhesion roll and the lower can section are being revolved at the same peripheral speed, the plastic tape 11 is transferred from the adhesion roll to the outer surface $10a_3$ of the open end portion 10*a* and is fused to the latter under heat and pressure.

Figure 3:
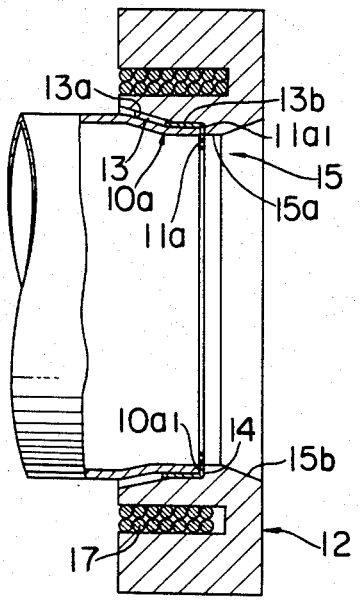
FIG. 3 is a view similar to FIG. 2 except that the lower can section is shown fitted in a die for use in forming the adhesive layer on the open end portion of the lower can section.

The open end portion 10*a* of the lower can section 10, to which the plastic tape 11 has been attached as in the foregoing, is then inserted into a die 12 shown in FIG. 3, thereby causing the projecting tape portion 11*a* to bend approximately radially inwardly at its proximal end $11a_1$ into contact with the entire surface of the edge $10a_1$ of the lower can section. The die 12 has formed therein a cavity 13 (hereinafter referred to as the can side cavity) for the insertion of the open end portion 10*a* of the lower can section, an annular shoulder 14 extending radially inwardly from the can side cavity 13, and another cavity 15 (hereinafter referred to as the mandrel side cavity) for the insertion of a mandrel 16 (FIG. 1) with the mandrel side cavity directly adjoining the annular shoulder 14.

The can side cavity 13 of the die 12 has a frustoconical guide surface 13*a* and a short cylindrical guide surface 13*b*. The diameter of the cylindrical guide surface 13*b* is approximately equal to the outside diameter $D_1$ of the open end portion 10*a* of the lower can section 10 plus twice the thickness t of the plastic tape 11. Thus the open end portion 10*a* of the lower can section having the plastic tape 11 thermally fused to its outer surface $10a_3$ can be closely inserted in the space bounded by the cylindrical guide surface 13*b*.

The cylindrical guide surface 13*b* of the die cavity 13 has an axial length less than that of the open end portion 10*a* of the lower can section 10. The cylindrical guide surface 13*b* could be omitted, leaving only the frustoconical guide surface 13*a* to define the can side cavity. However, the provision of the cylindrical guide surface 13*b* is advantageous for several reasons. First, it is effective to positively fold plastic tape that is intrinsically not readily foldable. Further, even if the plastic tape fused onto the outer surface $10a_3$ of the open end portion 10*a* of the lower can section is wrinkled, the cylindrical guide surface 13*b* can collapse and smooth out the wrinkles to make the tape constant in thickness all over the outer surface of the open end portion. As an additional advantage it serves to prevent the flaring of the open end portion 10*a* when the projecting tape portion 11*a* is folded and subsequently pressed against the inner surface 10*a*$_2$ of the open end portion by the mandrel 16 yet to be described.

The width or radial dimension of the annular shoulder 14 is approximately equal to the sum of the wall thickness of the open end portion 10*a* of the lower can section and the thickness t of the plastic tape 11. Accordingly, upon insertion of the open end portion 10*a* of the lower die section in the can side cavity 13, it butts against the annular shoulder 14, with the result that the projecting tape portion 11*a* becomes folded approximately radially inwardly, with the bend 11*a*$_1$ of the plastic tape caught between the annular shoulder 14 of the die and the edge 10*a*$_1$ of the lower can section.

The mandrel side cavity 15 of the die 12 comprises a guide surface 15*a* in the shape of a short cylinder, lying next to the annular shoulder 14, for guiding the mandrel 16, and a frustoconical guide surface 15*b*. The cylindrical guide surface 15*a* has a diameter approximately equal to the inside diameter D of the open end portion 10*a* of the lower can section.

The die 12 has a built-in high frequency induction heating coil 17 (hereinafter referred to as the heating coil) surrounding and adjoining the cylindrical guide surface 13*b* of the can side cavity 13. The heating coil 17 is intended to heat the open end portion 10*a* of the lower can section to a temperature, not less than the melting or softening point of the plastic tape 11, at which the plastic tape can be fused to the open end portion of the lower can section. The die 12 can be made from ceramics, Bakelite (trademark), fluoric resin, or like material that is not heated by electromagnetic induction and which is sufficiently strong and heat-resistant.

Figure 4:
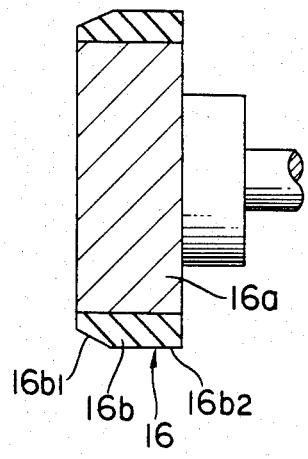
FIG. 4 is an axial section, partly in elevation, through the mandrel coacting with the die of FIG. 3 to form the adhesive layer on the open end portion of the lower can section.
Figure 5:
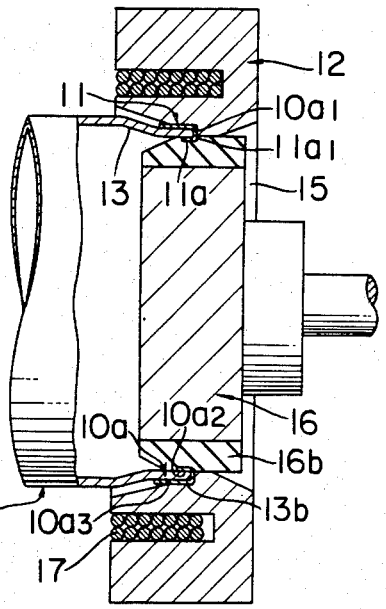
FIG. 5 is a view similar to FIG. 3 except that the mandrel of FIG. 4 is shown inserted in the open end portion of the lower can section through the die.

As shown in FIG. 4, the mandrel 16 comprises a rigid core 16*a* and a sleeve 16*b* of heat-resistant, elastic rubber. The sleeve 16*b* has a tapered portion 16*b*$_1$ disposed forwardly and a cylindrical portion 16*b*$_2$. The tapered portion 16*b*$_1$ is intended to expedite the insertion of the mandrel into the mandrel side cavity 15 of the die 12. The outside diameter of the cylindrical portion 16*b*$_2$ is equal to the remainder (D-2t) of the inside diameter D of the open end portion 10*a* of the lower can section minus twice the thickness t of the plastic tape 11. Upon full insertion of the mandrel 16 into the die 12 through its mandrel side cavity 15, as shown in FIG. 5, the sleeve 16*b* of the mandrel folds back the projecting tape portion 11*a* that has been bent approximately radially inwardly, and further resiliently presses the tape portion against the inside surface 10*a* of the open end portion of the lower can section. That part of the plastic tape 11 which has been bonded to the outer surface 10*a*$_3$ of the open end portion 10*a* is held against the cylindrical guide surface 13*b* of the can side cavity 13 of the die 12.

The elastic rubber of which the sleeve 16*b* of the mandrel 16 is molded should resist heat and wear and allow ready separation of the plastic tape 11 that has cured after melting or softening. Preferred examples are fluoroelastomer and silicone rubber. The hardness of the mandrel sleeve in Shore "A" should be from 30 to 90, preferably from 60 to 80. Should the hardness be less than 30, the mandrel sleeve would be too soft to exert a required degree of pressure. If the hardness is more than 90, on the other hand, then the mandrel sleeve would be too rigid for insertion into the open end portion 10*a* of the lower can section via the folded tape portion 11*a*.

Upon full insertion of the mandrel 16 as in FIG. 5, the heating coil 17 is energized to heat the open end portion 10*a* of the can section to a temperature at which the plastic tape is fused. Thereupon the proximal end portion 11*a*$_1$ of the projecting tape portion 11*a* becomes fused to the edge 10*a*$_1$ of the open end portion 10*a* of the can section, and the rest of the projecting tape portion 11*a* to the inside surface 10*a*$_2$ of the open end portion, both under pressure. The temperature to which the open end portion 10*a* of the can section is heated, and the pressure to be exerted by the mandrel 16, should both be determined so that the plastic tape 11 will remain substantially unaltered in thickness. The heating coil 17 is deenergized upon completion of the fusion of the projecting tape portion to the can section, and the mandrel 16 and the lower can section 10 is withdrawn from the die 12 upon curing of the plastic tape 11.

Thermally fused to the open end portion of the lower can section under an appropriate degree of yieldable pressure as in the foregoing, the plastic tape will not develop wrinkles or entrap air. Nor will it become thin or torn at the bends over the edge 10*a*$_1$ of the can section.

Figure 6:
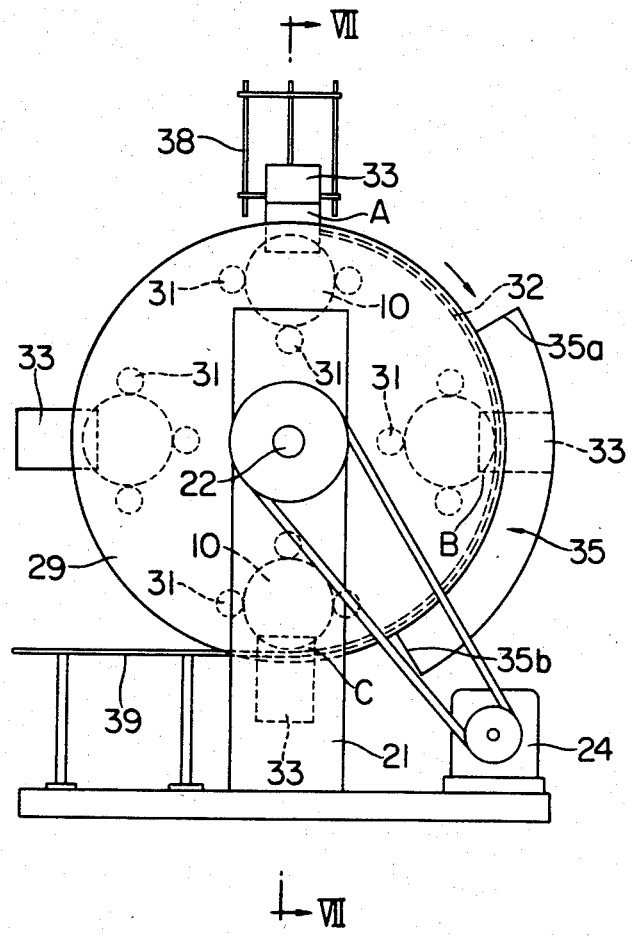
FIG. 6 is an elevation of apparatus for automatically creating adhesive layers on the open end portions of successive lower can sections, incorporating dies each constructed as in FIG. 3 and mandrels each constructed as in FIG. 4.
Figure 7:
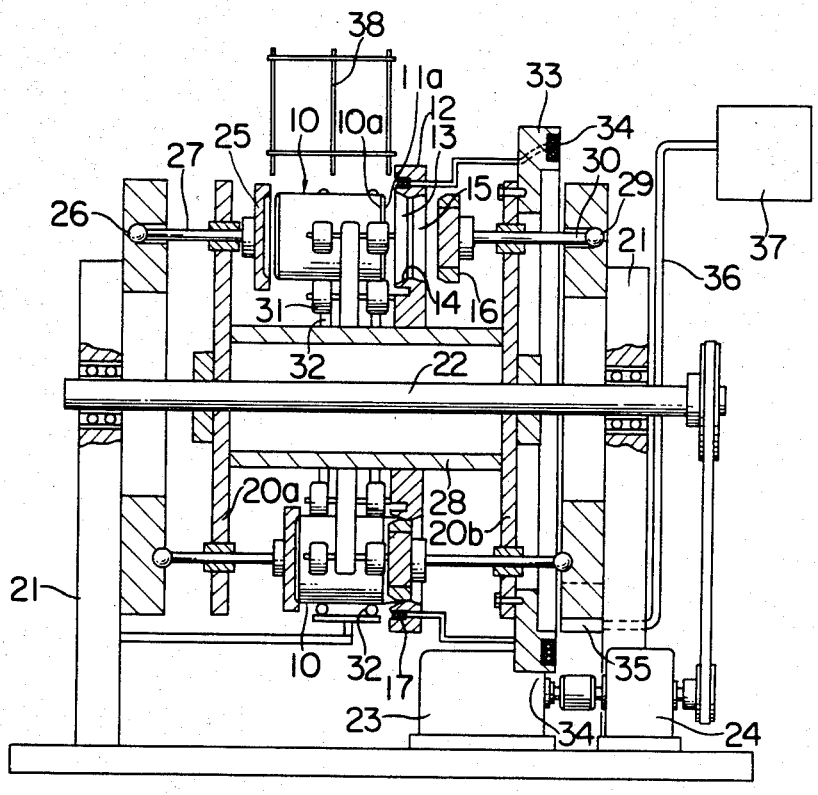
FIG. 7 is a vertical section through the apparatus of FIG. 6, taken along the line VII-VII therein.

FIGS. 6 and 7 illustrate an example of apparatus incorporating dies 12 and mandrels 16 of the above described configurations for thermally fusing the projecting portions 11*a* of the plastic tape pieces, which have been heat bonded to the outside surfaces of the open end portions 10*a* of lower can sections 10, to their edges and inside surfaces in rapid succession.

The reference characters 20*a* and 20*b* denote a pair of rotary discs fixedly mounted on a rotatable shaft 22 supported horizontally by a pair of side frames 21. The discs 20*a* and 20*b* are driven at a constant speed in the direction of the arrow in FIG. 6 by an electric motor 23 coupled via a speed reducer 24 to the shaft 22 in driving relationship. Four can pushers 25 are supported by the left hand rotary disc 20*a* at constant angular spacings for horizontal sliding motion. The can pushers 25 have cam followers 27 associated with a fixed cam 26 for pushing the open end portions 10*a* of lower can sections 10 into respective dies 12 which are fixedly mounted on a cylindrical support 28 anchored to the pair of rotary discs 20*a* and 20*b*. The fixed cam 26 is so contoured that each can pusher 25 is retracted away from the corresponding one of the dies 12 at a supply station A at the top of the apparatus. On its movement in the arrow marked direction from the supply station A, the can pusher is immediately thrusted forwardly to push the open end portion 10*a* of the corresponding can section 10 into the can side cavity 13 in the corresponding die 12. Then, immediately before reaching a delivery station C at the bottom, the can pusher is pulled back to the retracted position, although in FIG. 7 the can pusher is shown in its working position at the delivery station to facilitate understanding.

The right hand rotary disc 20*b*, on the other hand, supports four mandrels 16 so as to allow their sliding motion in the horizontal direction. Disposed opposite to the dies 12 on the cylindrical support 28, the mandrels have each a cam follower 30 associated with a fixed cam 29. The contour of the fixed cam 29 is such that each mandrel 16 is thrusted leftwardly into the mandrel side cavity 15 in the corresponding die 12 immediately after one of the can sections 10 is forced into the can side cavity 13 in the die to press the proximal end portion $11a_1$ of the projecting tape portion 11*a* against the annular shoulder 14 of the die. Thus cammed into and through the mandrel side cavity 15 in the die 12, the mandrel 16 folds back the projecting tape portion against the inside surface $10a_2$ of the open end portion of the can section. The mandrel 16 is pulled back to its retracted position prior to the retraction of the corresponding can pusher 25 immediately before reaching the delivery station C. Each lower can section 10 is supported by rolls 31 on the cylindrical support 28 as it travels along guide rods 32.

The heating coil 17 built into each die 12 is electrically connected to a high frequency oscillator 37 via a secondary coil 34 supported by one of secondary coil holders 33 mounted on the right hand rotary disc 20*b* in opposed relation to the dies 12, a primary coil (not shown) housed in a primary coil holder immovably mounted at a heating station B intermediate the supply station A and the delivery station C, and a feeder 36. The unshown primary coil and each secondary coil 34 constitute in combination a kind of rotary transformer. Accordingly each heating coil 17 is energized only while the corresponding secondary coil 34 is held opposite to the unshown primary coil, that is, while the corresponding secondary coil holder 33 is traveling through the heating station B in opposed relation to the prrmary coil holder 35.

In the apparatus constructed as in the foregoing, one lower can section 10 is dropped from the supply chute 38 as each associated group of can support rolls 31, die 12, can pusher 25, mandrel 16, secondary coil 34, etc., reaches the supply station A, as illustrated in FIG. 7. Immediately after the lower can section 10 falls on one set of support rolls 31, the corresponding can pusher 25 and mandrel 16 are cammed to their working positions for folding back the projecting tape portion 11*a* and pressing the same against the inner surface $10a_2$ of the open end portion 10*a* of the lower can section before the corresponding secondary coil holder 33 reaches the upper extremity 35*a* of the primary coil holder 35.

While the secondary coil holder 33 is subsequently travelling in opposed relation to the primary coil holder 35, the heating coil 17 built into the die 12 under consideration heats by electromagnetic induction the open end portion 10*a* of the lower can section 10 to a temperature at which the plastic tape on the can section is fused onto the edge $10a_1$ and inside surface $10a_2$ of the open end portion of the lower can section. The heating coil 17 becomes deenergized when the secondary coil holder 33 travels past the lower extremity 35*b* of the primary coil holder 35, allowing the plastic tape 11 to cool and cure on the lower can section 10 before it reaches the delivery station C. Then, with the mandrel 16 and the can pusher 25 retracted, the lower can section 10 is unloaded by means (not shown) onto a table 39 at the delivery station C.

The open end portions 10*a* of the lower can sections may be heated by heated air, infrared rays, or direct fire, with the dies 12 removed from the can sections and with the mandrels 16 held inserted in their open end portions, instead of by the heating coils 17. High frequency induction heating is preferred, however, by reasons of the high speed at which the can sections can be heated to a required temperature, the uniformity of the heat applied in their circumferential direction, and the simplicity of the means required. It is also possible to immovably hold the successive lower can sections 10 on the cylindrical support 28 and to move the dies 12 and mandrels 16 back and forth with respect to the lower can sections.

The invention will now be described in terms of a more specific Example thereof.

EXAMPLE

There was used a sheet of aluminum alloy (Material 3004, H26) having a thickness of 0.23 millimeter and bearing organosol coatings on its opposite faces. The aluminum alloy sheet was processed by usual punching and drawing into cuplike lower can sections 10 having an outside diameter of 84.11 millimeters. The open end of each can section was then reduced in diameter to provide the open end portion 10*a* having an outside diameter of 83.65 millimeters and a width of five millimeters.

As the thermoplastic tape 11 there was used denatured linear polyester tape (softening point 178° C.) having a thickness of 80 micronmeters and a width of six millimeters. This tape was cut to lengths of 267 millimeters. Each length of tape was heat bonded onto the outer surface of the reduced diameter open end portion of one can section, which had been heated by high frequency electromagnetic induction, so as to provide a projecting portion 11*a* with a width of 1.5 millimeters.

The die 12 in use was of Bakelite, configured as in FIG. 3. The frustoconical guide surface 13*a* of the can side cavity 13 of the die was tapered at an angle of 10 degrees. The cylindrical guide surface 13*b* of the can side cavity had a diameter of 83.81 millimeters and an axial length of two millimeters. The annular shoulder 14 of the die had a width of 0.30 millimeter. The mandrel 16 in use was of FIG. 4 construction, having the sleeve 16*b* molded from silicone rubber with a hardness of 80 Shore "A". The cylindrical portion $16b_2$ of the sleeve had an outside diameter of 83.60 millimeters and a thickness of 10 millimeters. With use of the above die 12 and mandrel 16 the projecting portion 11*a* of the plastic tape 11 was folded and pressed against the edge $10a_1$ and inner surface $10a_2$ of the open end portion $10a_1$ of each can section. The heating coil 17 was energized to heat the open end portion 10*a* of the can section to 200° C. thereby causing adhesion of the projecting tape portion 11*a* to the edge $10a_1$ and inner surface $10a_2$ of the open end portion of the can section. Upon curing of the plastic tape the can section was withdrawn from the die.

An inspection of the above treated open end portion 10*a* of each can section revealed the positive adhesion of the plastic tape 11 all over, without any wrinkles or entrapped air. Further a microscopic inspection of the tape sections indicated a substantially constant thickness of the tape on all of the outside surface $10a_3$, edge $10a_1$ (inclusive of its opposite corners) and inside surface $10a_2$ of the open end portion of each can section.

The following is a description of the method of, and means for, joining the lower can section 10, to which the adhesive layer 4 has been applied as above, to the upper can section 2.

Figure 8:
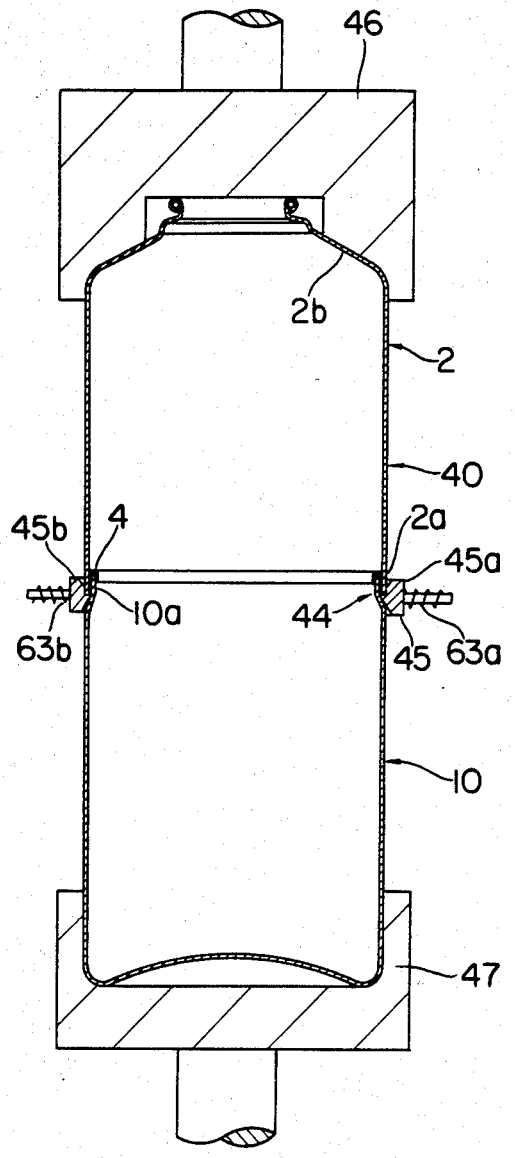
FIG. 8 is a section through an example of means for interengaging the upper and lower can sections.

As illustrated in FIG. 8, the means for joining the upper and lower can sections comprise die means 45, a pusher 46 for the upper can section 2, and a pusher 47 for the lower can section 10.

Figure 9A:
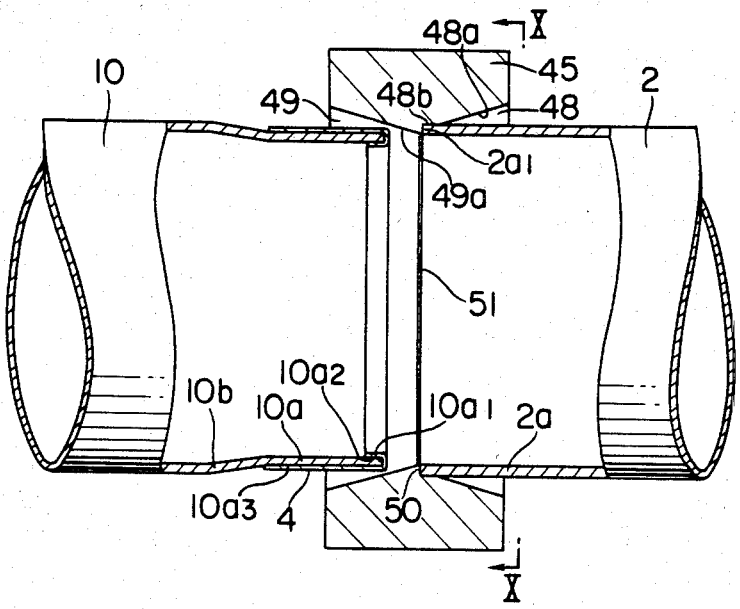
FIG. 9*a* is an enlarged, fragmentary axial section through the means of FIG. 8, with the upper and lower can sections shown in a state immediately before being interengaged.
Figure 10:
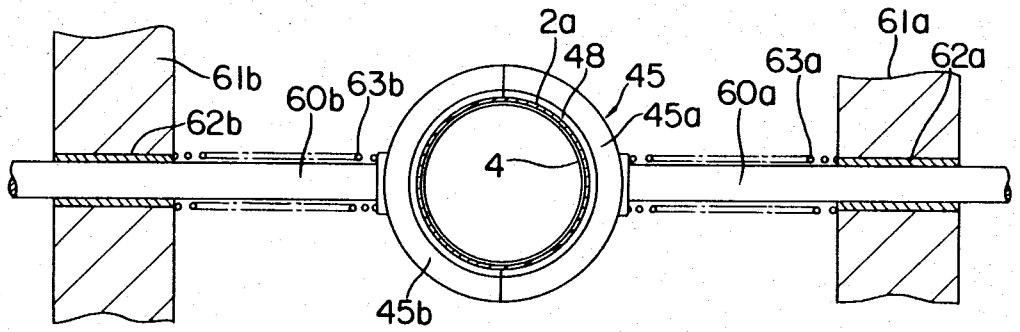
FIG. 10 is a section taken along the line X—X of FIG. 9*a* and drawn on a reduced scale.

The die means 45 include a pair of split dies (or split tools) 45*a* and 45*b*, as best seen in FIG. 10. It will be observed from FIG. 9*a* that when held against each other, the pair of split dies define a cavity 48 for the insertion of the open end portion 2*a* of the upper can section 2 and a cavity 49 for the insertion of the reduced diameter open end portion 10*a* of the lower can section 10. The cavity 48 is composed of an entrance guide surface 48*a* of frustoconical shape and another guide surface 48*b* in the shape of a short cylinder in which the open end portion 2*a* of the upper can section 2 can be fitted. By the word "fitted" is meant a relatively loose fit with a clearance of, for example, not more than about 0.2 millimeter, such that the open end portion 2*a* of the upper can section 2 can be fixedly supported in concentric relation with the die means 45 and reshaped into exactly circular form.

The die means 45 have an annular shoulder 50 positioned next to the cylindrical guide surface 48*b* and extending radially inwardly therefrom. Although the radial dimension of the annular shoulder 50 is shown to be equal to the wall thickness of the open end portion 2*a* of the upper can section 2, the radial dimension may be greater than the wall thickness to an extent that will not result in the buckling of the can section (e.g., up to about 0.2 millimeter). The annular shoulder 50 has a surface 51 of extremely small width which determines its inner diameter. Through this cylindrical surface 51 the annular shoulder 50 adjoins a frusto-conical guide surface 49*a* defining the cavity 49, with the guide surface 49*a* increasing in diameter as it extends away from the annular shoulder. This mode of adjoining is termed "substantially adjoining" in this specification. The frustoconical guide surface 49*a* is tapered at such an angle that it will not contact the shoulder 10*b* of the lower can section 10 upon its full insertion in the upper can section 2, as will be understood from a study of FIG. 9*d*.

The pair of split dies 45*a* and 45*b* have drive shafts 60*a* and 60*b* secured thereto and extending radially outwardly therefrom in opposite directions for opening and closing the die means 45. The drive shafts 60*a* and 60*b* extend through respective fixed members 61*a* and 61*b* via bushings 62*a* and 62*b* for horizontal sliding motion.

A helical compression spring 63*a* is sleeved upon the drive shaft 60*a* between split die 45*a* and fixed member 61*a*. Another helical compression spring 63*b* is sleeved upon the other drive shaft 60*b* between split die 45*b* and fixed member 61*b*. For opening the die means 45, the pair of drive shafts 60*a* and 60*b* are moved radially outwardly of the dies by a cam or like actuating mechanism (not shown). The die means 45 can be closed as the drive shafts 60*a* and 60*b* travel toward each other under the forces of the compression springs 63*a* and 63*b*.

It is therefore the compression springs 63*a* and 63*b* that determine the force exerted by the split dies 45*a* and 45*b* on the open end portion 2*a* of the upper can section 2 while it is being joined with the lower can section 10. The forces of these compression springs are enough to hold the split dies 45*a* and 45*b* completely closed until the lower can section 10 is inserted into the upper can section 2 to the extent depicted in FIG. 9*b*. Further the modulus of elasticity of the compression springs is so determined that the open end portion 2*a* of the upper can section is expansible against the spring forces during the time from the state of FIG. 9*b* to the full insertion of the lower can section 10 into the upper can section 2.

Figure 11:
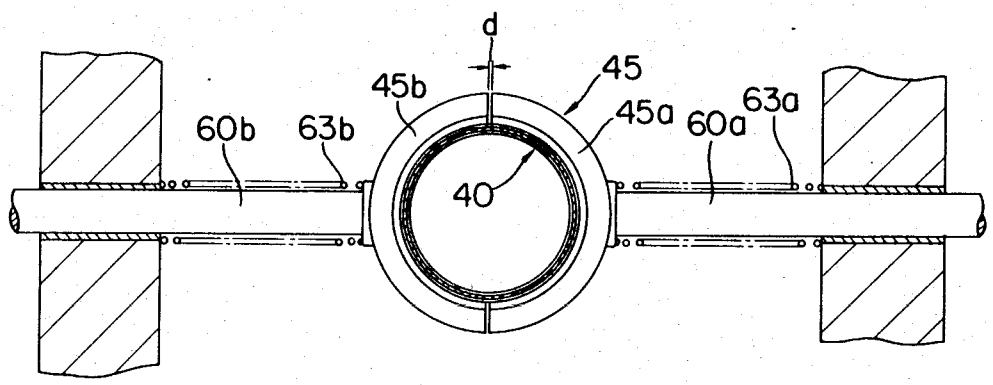
FIG. 11 is a section taken along the line XI—XI of FIG. 9*d* and drawn on a reduced scale.

With reference to FIG. 11, let d be the spacing between the pair of split dies 45*a* and 45*b* upon full insertion of the lower can section 10 into the upper can section 2. Then the displacement of each split die 45*a* or 45*b* is d/2. The elastic modulus of each compression spring should be such that the maximum force tending to expand the open end portion 2*a* of the can section 2 during the insertion of the open end portion 10*a* of the other can section 10 thereinto is greater than $F_0+d\epsilon/2$, wherein $F_0$ is the initial spring force tending to close the dies, and $\epsilon$ is the elastic modulus of the springs.

Figure 9B:
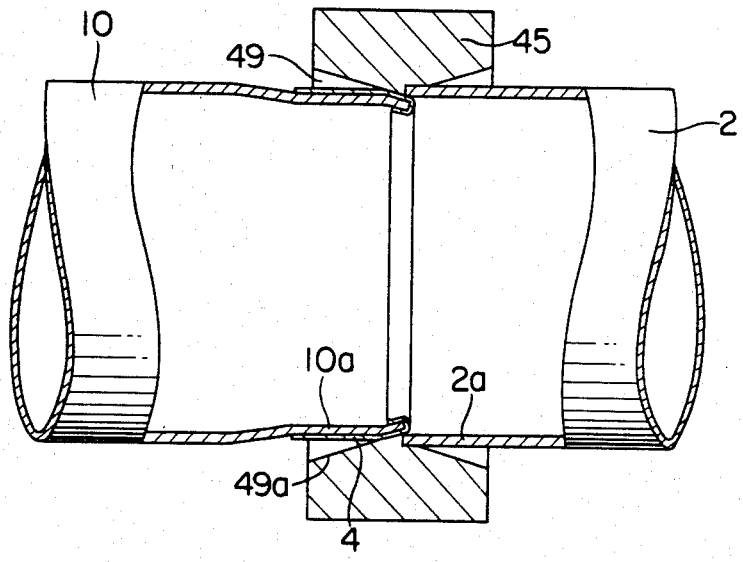
FIG. 9*b* is a view similar to FIG. 9*a* except that the reduced diameter open end portion of the lower can section is shown only slightly engaged in the open end portion of the upper can section.

The upper 2 and lower 10 can sections are joined together by the die means 45 in the following manner. First, with the split dies 45*a* and 45*b* closed against each other, the open end portion 2*a* of the upper can section 2 is inserted into the die cavity 48 by the pusher 46 until the edge $2a_1$ of the upper can section butts against the annular shoulder 50 of the dies, as illustrated in FIG. 9*a*. Thus inserted in the die cavity 48, the open end portion 2*a* of the upper can section 2 is fixed against displacement and also is reshaped into exactly circular shape in cross section. Then the open end portion 10*a* of the lower can section 10 is inserted by the pusher 47 into the die means 45 through its cavity 49 in concentric relation with the upper can section 2. The outside diameter of the open end portion 10*a* of the lower can section 10, inclusive of the adhesive layer 4 applied thereto, is greater than the inner diameter of the annular shoulder 50 of the die means 45 by twice the thickness of the adhesive layer. Consequently, before reaching the annular shoulder 50 of the die means, or the edge $2a_1$ of the upper can section 2, the adhesive layer 4 on the outer surface $10a_3$ of the open end portion 10*a* of the lower can section partly contacts the frustoconical guide surface 49*a* of the die cavity 49. With the continued insertion of the lower can section 10 its open end portion 10*a* becomes substantially resiliently bent inwardly and thus partly inserted in the open end portion 2*a* of the upper can section 2, as represented in FIG. 9*b*.

The split dies 45*a* and 45*b* have so far been held completely closed under the forces of the compression springs 63*a* and 63*b*. Should the dies 45*a* and 45*b* be opened by this time, the leading end of the open end portion 10*a* of the lower can section 10 would not be bent inwardly, thus failing to enter the open end of the upper can section 2.

Figure 9C:
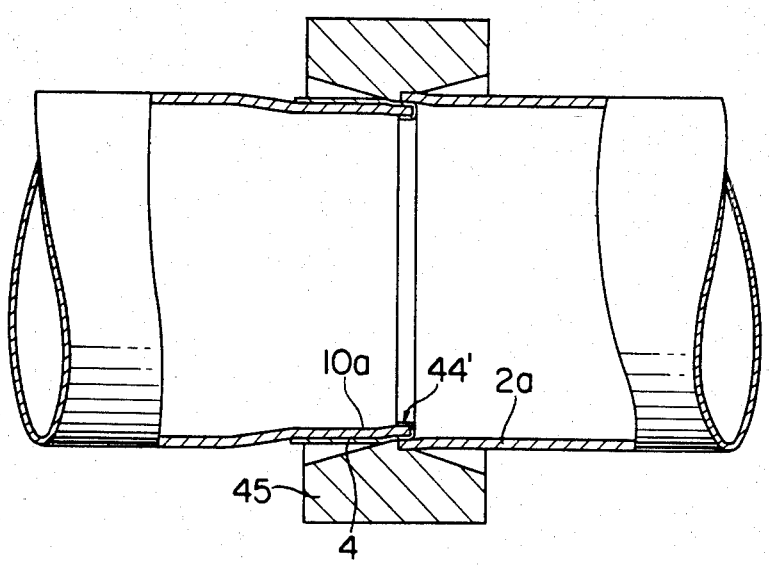
FIG. 9*c* is also a view similar to FIG. 9*a* except that the reduced diameter open end portion of the lower can section is shown engaged in the open end portion of the upper can section to a greater extent than in FIG. 9*b;*
Figure 9D:
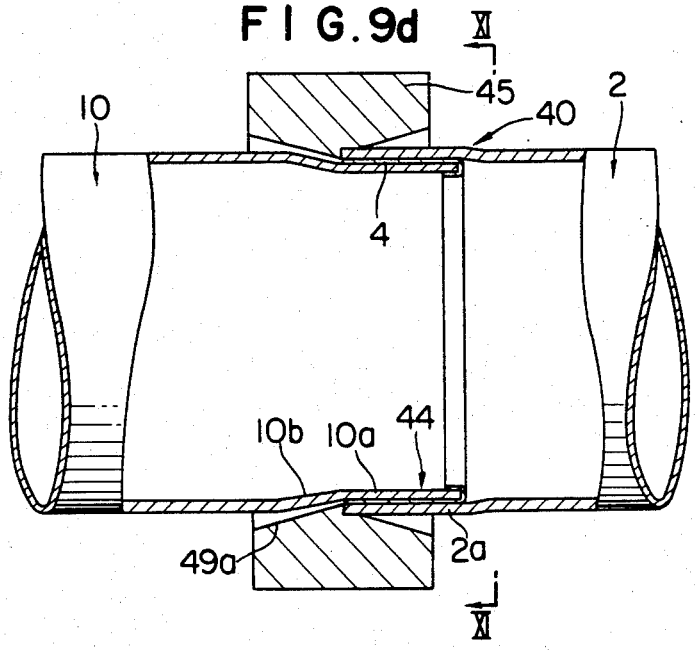
FIG. 9*d* is also a view similar to FIG. 9*a* except that the reduced diameter open end portion of the lower can section is shown fully engaged in the open end portion of the upper can section.

As the lower can section 10 is further forced into the upper can section 2, the die means 45 will be spread apart slightly, allowing the open end portion 2*a* of the upper can section 2 to expand at its part overlying the inserted end of the lower can section 10, as indicated at 44' in FIG. 9*c*, such being the elastic modulus of the compression springs 63*a* and 63*b*. The lapping parts 44 of the open end portion 2*a* of the upper can section 2 and the open end portion 10*a* of the lower can section 10 will be substantially resiliently expanded and contracted, respectively, to extents corresponding to the thickness of the adhesive layer 4. Some plastic deformation of the mating parts of the can sections at this time will do no harm. The clamping forces of the die means are now overcome. The subsequent driving of the lower can section 10 into the upper can section 2 to approximately the full axial length of the open end portion 10*a* of the former makes up an airtight lap seam 44 shown in FIG. 9*d*. As has been explained in the foregoing, the outer end portion 2*a* is expanded with the insertion of the open end portion 10*a* therein. Thus, being contracted to a correspondingly smaller degree, the underlapping open end portion 10*a* of the lower can section will not easily suffer buckling. The drive shafts 60*a* and 60*b* are pulled apart from each other after the lap seam 44 has been formed, and the metal can assembly 40 thus completed is withdrawn from the die means 45.

The lap seam 44 created as above is subject to internal radial pressure due to the springback of the lapping parts. It can therefore be made impervious to fluid as the lapping parts are heat sealed to each other by heating them by means such as a high frequency induction heating coil, not shown, to a temperature at which the adhesive layer 4 is fused.

Figure 12:
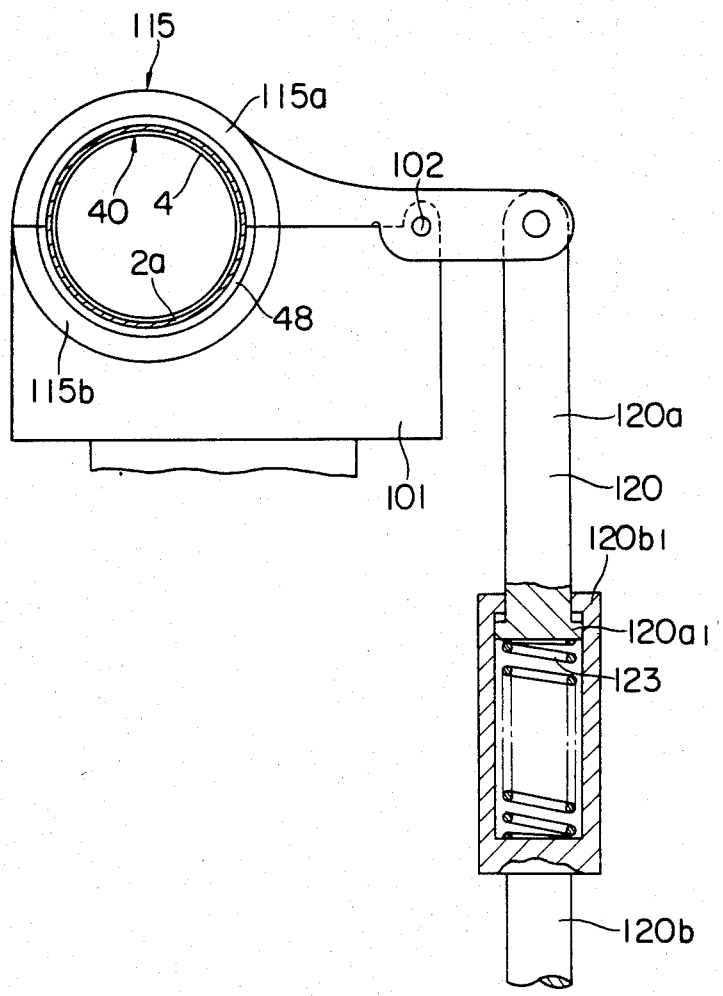
FIG. 12 is an elevation, partly in section, of another example of means for interengaging the upper and lower can sections.

In FIG. 12 is shown another embodiment of the invention wherein die means 115 comprise a pair of split dies 115*a* and 115*b*. The lower die 115*b* is secured to a stationary member 101 whereas the upper die 115*a* is pivotally mounted on the stationary member 101 via a pin 102. The upper die 115*a* is pivoted toward and away from the lower die 115*b* as a drive shaft 120 having a compression spring 123 arranged medially therein is moved up and down by a drive mechanism (not shown) such as a cam mechanism.

In this embodiment, too, the force to be exerted by the helical compression spring 123 on the die means 115 in the initial stage of joining the can sections, and its elastic modulus, are determined as in the foregoing. As the lower drive shaft member 120*b* is lowered upon completion of the joining of the can sections, the upper end 120$b_1$ of the lower drive shaft member 120*b* and the upper drive shaft member 120*a* descend to cause the upper die 115*a* to pivot in a clockwise direction about the pivot pin 102, so that the lap-seamed metal can assembly 40 can be withdrawn from the die means 115.

The die means 115 of the above construction offers the advantage that, since the lower die 115*b* is held against displacement, the axis of the dies is to undergo no displacement, making it possible for the can sections to be positively joined to each other in axial alignment. Further, even though the lower die 115*b* is fixed, the upper die 115*a* is displaceable away from the lower die with the progress of the joining of the can sections, and the open end portion of one of the can sections expands only slightly, so that this embodiment is nearly as effective to prevent buckling as that of FIG. 10.

In both of the embodiments of FIGS. 10 and 12 the resilient means could take the form of air cylinders instead of the coil springs. Specifically, in the embodiment of FIG. 10, the drive shafts 60*a* and 60*b* may be replaced by the piston rods of air cylinders. In this case the bulk modulus of the compressed air in the air cylinders correspond to the elastic modulus of the springs.

Additional examples of the resilient means are elastic rubbers and solenoids.

In the embodiments so far described, the tightening force exerted on the can sections by the dies was released shortly after the insertion of the open end portion 10*a* of one can section in that of the other. However, the tightening force may not be released during this process if the open end portion 10*a* is of a material (e.g., relatively thick sheet steel) that is of comparativity high rigidity and which, therefore, will not easily buckle.

Described hereafter are a method of, and means for, heat bonding pieces of plastic tape 11 to the outer surfaces 10$a_3$ of the open end portions 10*a* of lower can sections 10.

Figure 13:
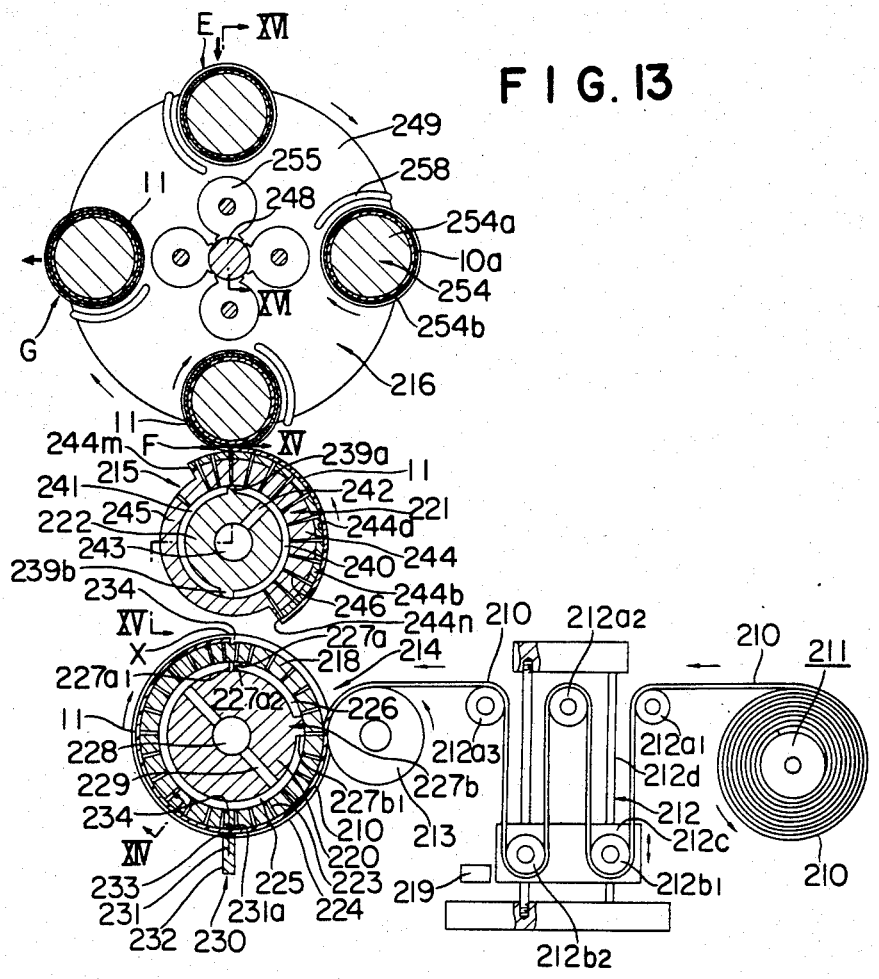
FIG. 13 is a vertical section, partly in elevation, of an example of means for heat bonding pieces of plastic tape to the open end portions of successive lower can sections.

In FIG. 13 the reference numeral 211 denotes a supply reel for paying out a continuous length of tape 210. The apparatus further comprises a looper 212, a pinch roll 213, a tape piece supply roll assembly 214, an adhesion roll assembly 215, and a transport mechanism 216 for lower can sections 10. Unwound from the supply reel 211, the tape 210 passes the looper 212 and is wound by the pinch roll 213 around a supply roll 218 of the tape piece supply roll assembly 214 by suction. The supply roll 218 is intermittently driven in the arrow marked direction at a constant peripheral speed v by a drive mechanism shown in FIG. 17, which will be described later. Correspondingly there are provided a drive mechanism (not shown) for intermittently rotating the pinch roll 213 in the arrow marked direction at the peripheral speed v and a controlled drive mechanism (not shown) for revolving the supply reel 211 at controlled variable speed so that the tape may be fed out at the linear speed v.

Intended for use as the adhesive layers 4 on the lower can sections, the tape 210 is normally of thermoplastic film, having a small width (e.g., four to 10 millimeters) and small thickness (e.g., 30 to 100 micronmeters). Should the tape be wrapped around the supply roll 218 under tension, it would contract on being cut into separate pieces 11. Thus each tape piece 11 would not have a required length. The looper 212 acts between supply reel 211 and pinch roll 213 to prevent any violent tensioning of the tape 210.

Guide rolls 212$a_1$, 212$a_2$ and 212$a_3$ are disposed in fixed positions whereas guide rolls 212$b_1$ and 212$b_2$ are supported for up-and-down motion. The latter guide rolls are rotatably mounted on a carriage 212*c* which is slidable up and down along fixed guide rods 212*d*. Thus, when the tape 210 is tensioned as by reason of the time lag of the control mechanism at the moments of the start and stop of the supply reel 211 and pinch roll 213, the guide rolls 212$b_1$ and 212$b_2$ are displaced upwardly to relieve the tension on the tape. A proximity switch is provided at 219 for automatically setting the supply reel 211 out of rotation when the carriage 212*c* comes to the lowermost position.

The tape piece supply roll assembly 214 further comprises a fixed cylinder 220 disposed in the hollow interior in the aforesaid supply roll 218 which is made from metal such as aluminium. Except for their shapes the supply roll 218 and the fixed cylinder 220 are analogous in construction with the adhesion roll 221 and fixed cylinder 222, respectively, of the adhesion roll assembly 215 yet to be described.

Figure 14:
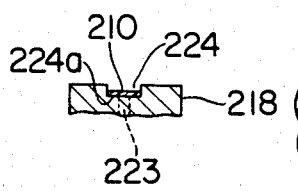
FIG. 14 is a section taken along the line XIV—XIV of FIG. 13.

The supply roll 218 has a multiplicity of suction ports 223 formed all over its surface and extending radially. Supplied onto the surface of the supply roll 218 by the pinch roll 213, the tape 210 is attached to and wrapped around its surface by partial vacuum created in the suction ports. As seen in FIG. 14, the supply roll 218 has a shallow groove 224 of approximately the same width as the tape 210 formed circumferentially therein for receiving the tape 210 from the pinch roll 213 and holding the same against lateral displacement on the supply roll. Preferably the groove 224 has its bottom 224*a* covered with a thin strip of rubber or like material to prevent the slipping of the tape 210.

Formed between the inner surface of the supply roll 218 and the outer surface of the fixed cylinder 220 are a vacuum chamber 225 and an air chamber 226, which are set off from each other by a first partition 227*a* and second partition 227*b* formed on the fixed cylinder 220. The outer edges of the two partitions 227*a* and 227*b* make slidable but airtight contact with the inner surface of the supply roll 218. The first partition 227*a* has a side surface 227$a_1$ bounding an end of the vacuum chamber 225, and another side surface 227$a_2$ bounding an end of the air chamber 226. Both of these side surfaces of the first partition 227*a* lie sufficiently close to a plane containing the axes of the supply roll 218 and adhesion roll 221, in order that the successive tape pieces 11 may be smoothly transferred from supply roll 218 to adhesion roll 221.

The second partition 227b is positioned opposite to the pinch roll 213. Its side surface 227b$_1$, bounding an end of the vacuum chamber 225, is slightly displaced toward the air chamber 226 from a plane containing the axes of the pinch roll 213 and supply roll 218. Consequently, on entering the gap between pinch roll 213 and supply roll 218, the tape 210 becomes immediately drawn into and held in the groove 224 by suction. The vacuum chamber 225 communicates with a vacuum pump (not shown) by way of radial passages 229 and an axial passage 228 in the fixed cylinder 220.

At 230 is shown a cutter assembly disposed in a fixed angular position relative to the tape piece supply roll assembly 214. Included is a cutter 231 whose cutting edge 231a has a width approximately equal to the width of the tape 210. However, if grooves 234 later described have each a width greater than that of the groove 224, the width of the cutting edge 231a may be greater than that of the tape 210. The cutter assembly 230 further comprises, in addition to the cutter 231 which tapers in the transverse direction of the tape 210, a holder 232 of the cutter 231, and a cushion 233 of elastic rubber or like material affixed to the holder 232 in the vicinity of the edge 231a of the cutter 231. The cutter assembly 230 is reciprocated in a radial direction of the tape piece supply roll assembly 214 by a drive mechanism not shown.

The groove 224 in the supply roll 218 has the above mentioned grooves 234 cut in its bottom 224a at prescribed circumferential spacings. The circumferential dimension of the cushion 233 is set greater than that of each groove 234. The rotation of the supply roll 218 is stopped each time one of the grooves 234 comes to a position opposite the cutter assembly 230. The aforesaid drive mechanism is so controlled that the cutter assembly 230 is thrusted radially inwardly at an appropriate moment (indicated at s in FIG. 19b) during this temporary stop of the supply roll 218. Thereupon the cutting edge 231a of the cutter assembly cuts the tape 210 to provide a tape piece 11 and becomes engaged in one of the grooves 234, with the tape held against movement by the cushion 233 in the groove 224 on opposite sides of the groove 234. The tape can thus be cut off positively. The circumferential spacings between the grooves 234 (the circumferential distance from lower groove 234 to upper groove 234 in the arrow marked direction) is so determined that the length of each severed piece of tape 11 is substantially equal to the outer circumference of the open end portion 10a of each lower can section 10 seen in FIG. 16.

The word "substantially" is used above because each tape piece 11 may be longer than the outer circumference of the open end portion 10a of each lower can section 10 by approximately one to three millimeters.

Figure 15:
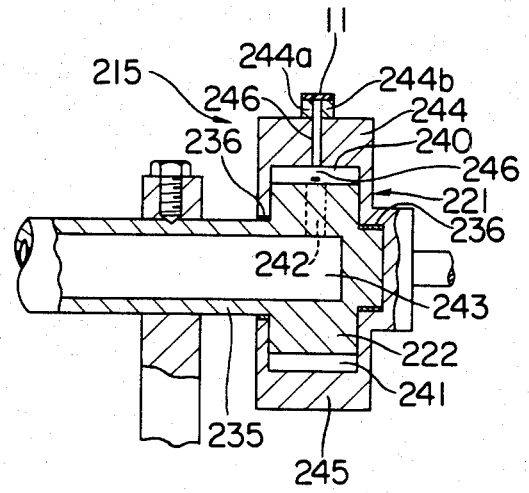
FIG. 15 is a section taken along the line XV—XV of FIG. 13 and drawn on an enlarged scale.

As illustrated in detail in FIG. 15, the fixed cylinder 222 of the adhesion roll assembly 215 is formed on one end of a hollow stationary shaft 235. The adhesion roll 221 is concentrically mounted on the fixed cylinder 222, making slidable but airtight contact therewith via bushings 236. The adhesion roll 221 is rotated by its drive mechanism, described later with reference to FIG. 17, in the direction of the arrow in FIG. 13 so that the speed of its tape applying surface 244a will have the required value v. A first partition 239a and second partition 239b on the fixed cylinder 222 divide the gap between adhesion roll 221 and fixed cylinder 222 into a vacuum chamber 240 and an air chamber 241. The vacuum chamber 240 communicates with a vacuum pump (not shown) by way of a radial passage 242 in the fixed cylinder 222 and an axial passage 243 extending through the stationary shaft 235.

The adhesion roll 221 comprises a tape applying portion 244 having a tape applying surface 244a, and a reduced radius portion 245 having a radius less than that of the tape applying portion 244. The circumferential length of the tape applying surface 244a is equal to (as in the case of FIG. 13) or slightly (e.g., approximately 20 percent) more than the length of each tape piece 11.

As seen in FIG. 15, the tape applying surface 244a of the adhesion roll 221 is defined by a layer 244b of heat-resistant elastic rubber (e.g., silicone rubber) having a width approximately equal to that of each tape piece 11 and having a height or thickness slightly more than the difference between the depth of the groove 224 in the supply roll 218 and the thickness of the tape piece 11. The tape applying portion 244 has formed therein a multiplicity of suction ports 246 extending radially and communicating with the vacuum chamber 240. The tape piece supply roll assembly 214 and the adhesion roll assembly 215 are of such relative arrangement that when the tape applying portion 244 comes opposite to the roll 218, the heat-resistant elastic rubber layer 244b becomes engaged in the groove 224 in the supply roll 218, with the spacing between the tape applying surface 244a and the bottom 224a of the groove 224 being approximately equal to the thickness of each tape piece 11.

Figure 16:
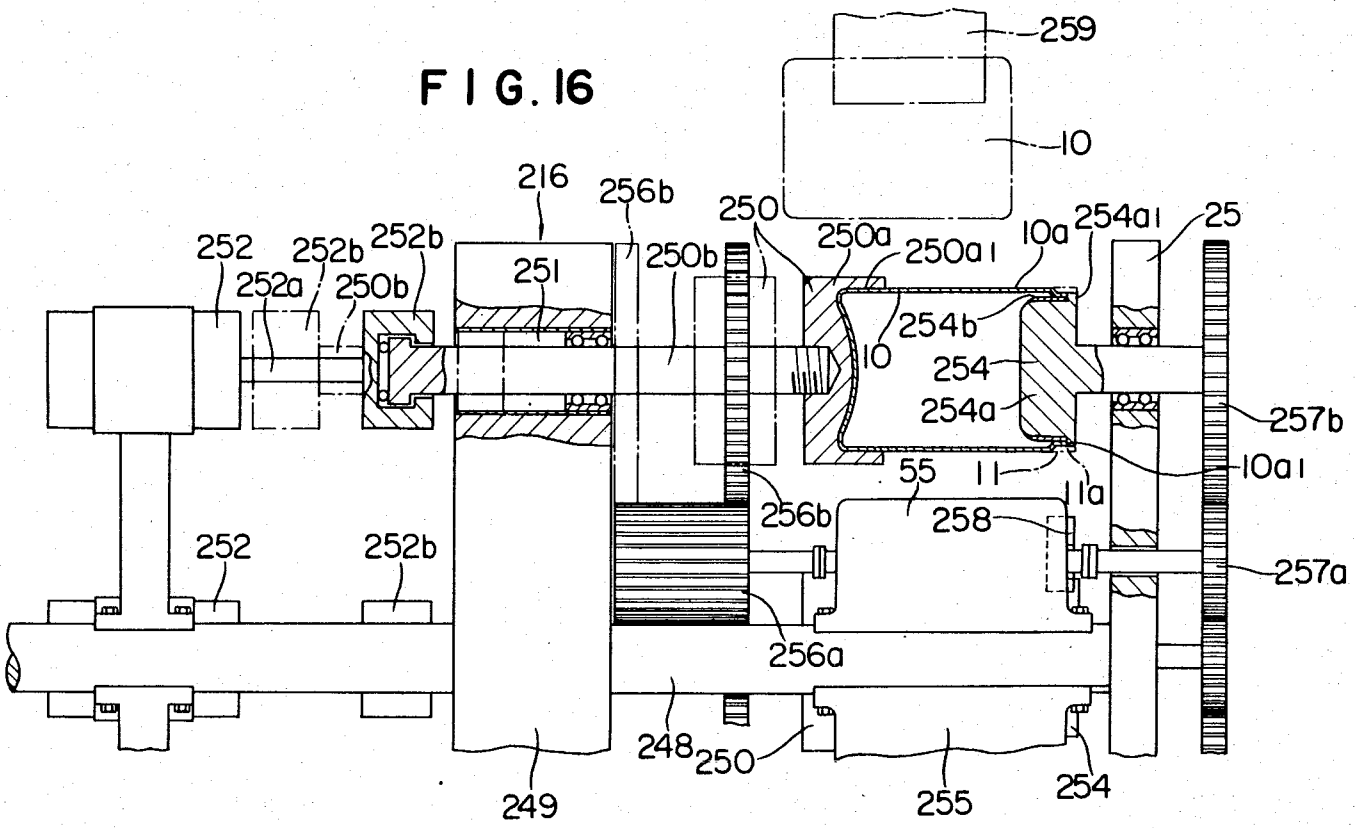
FIG. 16 is a section, partly in elevation, taken along the line XVI—XVI of FIG. 13 and drawn on an enlarged scale.

With reference to both FIGS. 13 and 16 the lower can section transport mechanism 216 comprises a rotary shaft 248, a rotary disc 249 fixedly mounted thereon, and lower can section holders 250. Each lower can section holder 250 comprises a holder body 250a having formed therein a recess 250a$_1$ for receiving the bottom end portion of one lower can section 10, and a shaft 250b secured to the holder body 250a so as to be coaxial with the lower can section 10 engaged in its recess 250a$_1$. A plurality of, four in the illustrated embodiment, such holders 250 are arranged at constant circumferential spacings on the rotary disc 249. The shafts 250b of the holders extend through respective bores 251 in the rotary disc 249 for axial sliding motion relative to the same, with the bores 251 being shown to be arranged at constant angular spacings on the rotary disc. The shaft 250b of each holder has its rear end rotatably engaged, via a joint 252b, with the shaft 252a of a solenoid (or fluid actuated cylinder) immovably supported on the rotary shaft 248.

Also fixedly mounted on the rotary shaft 248 is another rotary disc 253 which is disposed on that side of the lower can section holders 250 opposite to the side where the first recited rotary disc 249 lies. The rotary disc 253 rotatively supports a plurality of, four in the illustrated embodiment, mandrels 254 in opposed relation to the respective lower can section holders 250. Each mandrel 254 comprises a core 254a and a cushion layer 254b sleeved thereon. The core 254a is made from metal such as aluminium. Intended to make direct contact with the inner surface of the open end portion 10a of each lower can section 10, the cushion layer 254b is molded from heat-resisting elastic rubber, with a relatively small thickness (usually from one to 10 millimeters) and a hardness of 50 to 100 in Shore "A", or from a heat-resisting plastic.

In heat bonding a tape piece 11 to each lower can section 10, the cushion layer 254b of each mandrel 254 coacts with the heat-resisting elastic rubber layer 244b of the adhesion roll assembly 215 to assure uniform heat bonding of the tape piece without defects such as wrinkles or unadhering parts. If the cushion layer 254b were of a relatively thick, pliant piece of rubber, the open end portion of the lower can section would be deformed by pressure at the time of the heat bonding of the tape piece thereto, giving rise to the above defects. The core 254a of each mandrel 254 is formed to include a flange 254a$_1$ for engaging the edge 10a$_1$ of the open end portion 10a of the lower can section 10 and thus for positioning the lower can section in its axial direction.

A plurality of motors 255 are mounted on the rotary shaft 248 for joint rotation therewith. Each motor 255 is coupled to one lower can section holder 250 via gears 256a and 256b, and to one mandrel 254 via gears 257a are 257b, for synchronously driving the associated pair of holder and mandrel holding the lower can section 10 therebetween.

Disposed in the vicinities of the respective mandrels 254 are high frequency induction heating coils 258 (hereinafter referred to as the heating coils) of arcuate shape for heating the open end portions 10a of the lower can sections 10. These heating coils are mounted to the rotary disc 253 by support means which are not shown. The heating coils 258 are electrically connected to a high frequency oscillator via feeders and a rotary transformer.

FIG. 13 shows a supply station of successive lower can sections 10 at E, a tape applying station at F, and a delivery station at G. The rotary shaft 248 is driven intermittently by the drive mechanism shown in FIG. 17, which is to be described presently, in such a manner that its revolution is arrested for a prescribed length of time (during which one tape piece 11 is being thermally applied to one lower can section, that is, while the tape applying surface 244a of the adhesion roll assembly 215 is passing the tape applying station F) when the lower can section holders 250 reach the respective stations. Further the rotary shaft 248 rotates in the arrow marked direction while the reduced radius portion 245 of the adhesion roll 221 is passing the tape applying station F, at such a speed that the next lower can section 10 arrives at the tape applying station F at the instant the reduced radius portion has just passed the tape applying station.

The mandrels 254 of the lower can section transport mechanism 216 are so arranged that the open end portion of each lower can section supported thereby comes opposite to the tape applying surface 244a of the adhesion roll assembly 215 at the tape applying station F, with a spacing therebetween slightly less than the thickness of each tape piece 11 (for the application of pressure when it is being applied to the lower can section).

The successive can sections 10 are loaded on the transport mechanism 216 at the supply station E and unloaded therefrom at the delivery station G as follows. As one of the lower can section holders 250 comes to a stop at the delivery station G, a limit switch (not shown) activates the corresponding solenoid 252 thereby causing retraction of the lower can section holder 250 to the position indicated by the dot-and-dash lines in FIG. 16. Then, held by an unloading gripper (similar to a loading gripper 259 in FIG. 16), the lower can section 10 is moved toward the rotary disc 249 and so is disengaged from the corresponding mandrel 254 for delivery to the subsequent processing stage. The lower can section holder 250 in question stays in the retracted position until it reaches the supply station E. A new lower can section 10, indicated by the dot-and-dash lines in FIG. 16, is lowered, by being gripped by the loading gripper 259 when the lower can section holder 250 subsequently reaches the supply station E. When the lowered lower can section becomes coaxial with its holder 250, the unshown limit switch again activates the solenoid 252 thereby causing the same to move the holder 250 to the right in FIG. 16. Thus the bottom end portion of the lower can section 10 becomes fitted in the recess 250a$_1$ in the holder 250 whereas the edge 10a$_1$ of its open end portion 10a engages the flange 254a$_1$ of the mandrel 254.

While being subsequently transported from supply station E to tape applying station F, the lower can section 10 is revolved about its own axis by one of the motors 255 in the direction of the arrow in FIG. 13. At the same time the heating coil 258 is energized to uniformly heat the open end portion 10a of the lower can section to a temperature higher than the melting or softening point of the thermoplastic of which the tape pieces 11 are made. The flange 254a$_1$ and adjacent part of the mandrel 254 is heated at the same time to such a temperature that it serves to prevent rapid cooling of the open end portion 10a of the lower can section at the time of the application of the tape piece 11 thereto.

As required, the heating coil 258 may be held energized during the application of the tape piece 11 thereto, in order to prevent any part of the open end portion 10a of the lower can section from cooling to a temperature making impossible the heat bonding of the tape piece. Upon completion of the application of the tape piece, however, the heating coil 258 becomes deenergized and is so held until the next lower can section 10 is loaded at the supply station E and is set into rotation.

Figure 17:
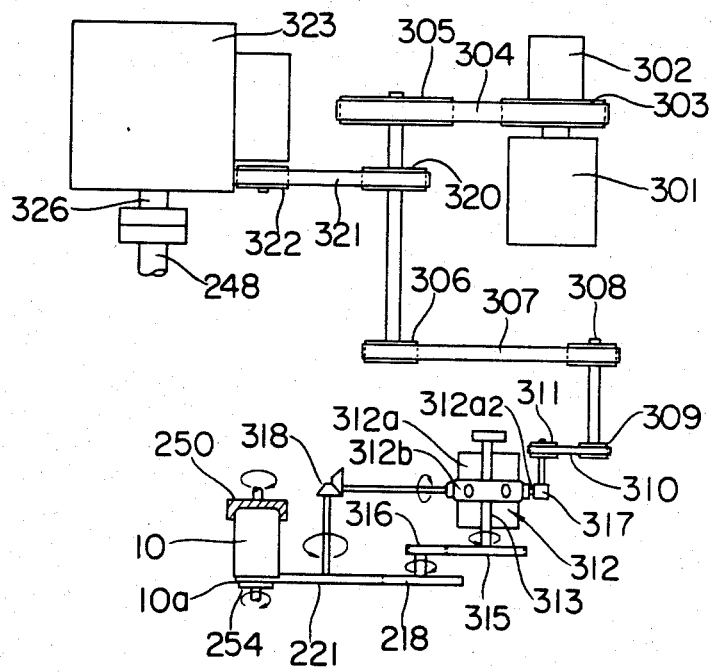
FIG. 17 is a diagrammatic plan of an example of drive mechanism for use with the means of FIG. 13.
Figure 18:
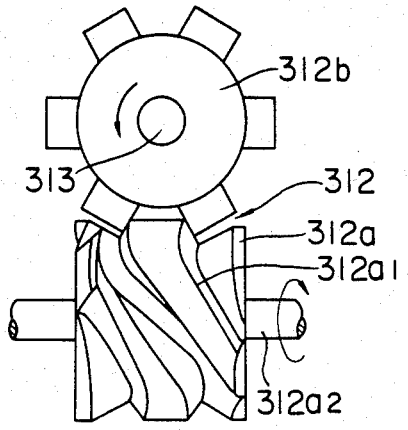
FIG. 18 is an enlarged elevation of a semi-constant speed cam mechanism in the drive mechanism of FIG. 17.

FIG. 17 illustrates the drive mechanism for the supply roll 218, the adhesion roll 221, and the rotary shaft 248 of the lower can section transport mechanism 216. An electric motor 301 imparts its constant speed rotation to a semiconstant speed cam mechanism 312 via a gearbox 302, pulley 303, endless belt 304, pulleys 305 and 306, endless belt 307 (the pulley 306 and belt 307 are of slip-free construction, as are all the combinations of pulleys and belts recited subsequently), pulleys 308 and 309, endless belt 310, pulley 311, and speed reducer 317. The pulleys 306 and 308 are equal in diameter, and so are the pulleys 309 and 311. As illustrated in greater detail in FIG. 18, the semiconstant speed cam mechanism 312 is, for example of the concave globoidal type, comprising a cam 312a and a cam follower 312b. The cam 312a has a rectilinear tooth portion 312a$_1$ to cause the constant speed motion of the cam follower 312b (from moment c to moment d in the graph of FIG. 19b).

The semiconstant speed cam mechanism 312 transmits the rotation of its output shaft 313 to the supply roll 218 via gears 315 and 316. The speed ratio of the gears 315 and 316 are one to two. This is because the semiconstant speed cam mechanism 312 is of the four-stop design, causing 90-degree revolution of the output shaft 313 with every 180-degree revolution of the input shaft 312a$_2$. Thus the intermeshing gears 315 and 316 serve to translate each 90-degree rotation of the cam output shaft 313 into that of 180-degrees.

The rotation applied to the input shaft 312a$_2$ of the semiconstant speed cam mechanism 312 is also applied, after bypassing the same, to the adhesion roll 221 via bevel gearing 318 having a gear ratio of one to one.

Figure 19A:
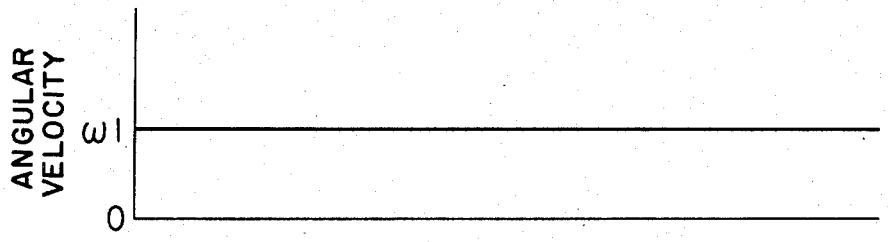
FIGS. 19*a* and 19*b* are graphs indicating the angular velocities of the adhesion roll and supply roll, respectively, of the means of FIG. 13 against time.
Figure 19B:
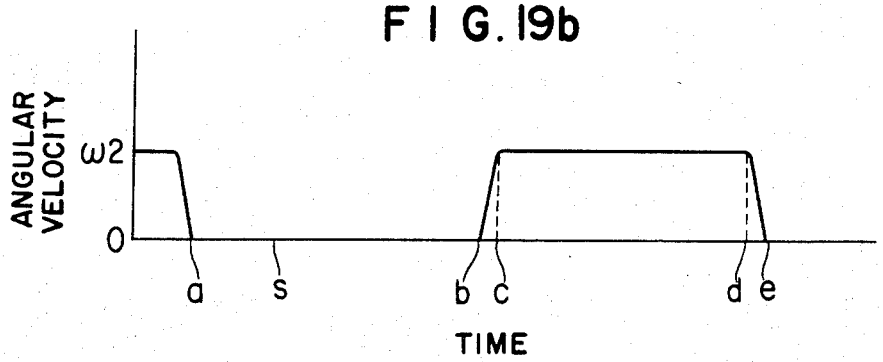

FIGS. 19a and 19b are explanatory of the rotational behaviors of the adhesion roll 221 and the supply roll 218, respectively, plotted on the assumption that the semiconstant speed cam mechanism 312 is of such construction that 90 percent of each rotating period of its output shaft is at constant speed. The adhesion roll 221 rotates continuously at a constant angular velocity $\omega_1$. The supply roll 218, on the other hand, is driven intermittently. During each complete revolution (360 degrees) of the input shaft of the cam mechanism from moment a to moment e, the supply roll 218 is held out of rotation from moment a to moment b, during which the cam mechanism input shaft rotates 180 degrees. During the following period from moment b to moment c (corresponding to nine degrees of rotation) the supply roll 218 is accelerated to angular velocity $\omega_2$, and is maintained at that angular velocity from moment c to moment d. Decelerated during the subsequent period (corresponding to nine degrees of rotation) from moment d to moment e (corresponding to moment a), the supply roll 218 comes to a stop at moment e. The tape 210 is cut to a required length at some moment s while the supply roll 218 is out of rotation.

Thus the supply roll 218 in this particular embodiment is held at constant angular velocity (from moment c to moment d) during 90 percent of each period of 180-degree rotation (from moment b to moment e). In this case the angular velocity $\omega_2$ of the supply roll 218 is approximately 1.075 times the angular velocity $\omega_1$ of the adhesion roll 221. However, as has been stated, the peripheral speed of the supply roll 218 and that of the tape applying surface **244*a* of the adhesion roll 221 must be equal, at v. In the particular apparatus of FIG. 13, therefore, the radius of the tape applying surface 244*a* of the adhesion roll 221 is made 1.075 times as long as the radius of the supply roll 218**.

Each tape piece 11 is transferred from supply roll 218 to adhesion roll 221 even during each period of acceleration (from moment b to moment c) and of deceleration (from moment d to moment e), when the supply roll 218 and adhesion roll 221 differ in peripheral speed. However, this difference in peripheral speed results only in the tensioning and consequent slipping of the tape piece 11 being transferred from supply roll 218 onto the tape applying surface **244*a* of the adhesion roll 221, so that the tape piece will not wrinkle on the tape applying surface or suffer other trouble. Nor will the tape piece be stretched or broken by the tension since the rolls revolve such small angles during the accelerating and decelerating periods of the supply roll 218**.

The period during which the supply roll 218 revolves at constant speed (from moment c to moment d) occupies 90 percent of each period of its 180-degree rotation (from moment b to moment e) in this particular embodiment. This proportion could be anywhere between 90 and 95 percent. However, the smaller the proportion, the greater will be the value of $\omega_2/\omega_1$. If the proportion is 50 percent, for example, then the value will be as much as 1.28. Further, the smaller the above proportion, the more will the tape slip during the accelerating and decelerating periods of the supply roll 218, and the more easily will the tape be stretched or broken. For these reasons the proportion should be as high as possible, preferably from about 80 to 95 percent. If it is more than 95 percent, difficulties will be encountered in creating the teeth of the semiconstant speed cam mechanism.

The supply roll 218 must be cyclically set into and out of rotation at constant speed for the smooth transfer of the successive pieces of tape 11 from supply roll 218 to the tape applying surface **244*a* of the adhesion roll 221** without any substantial slippage or without production of wrinkles. Although a variety of drive mechanisms can be adopted for this purpose, the semiconstant speed cam mechanism is particularly preferred by reasons of: (1) the absence of play, making possible the repeated stopping of the output shaft in exact angular positions required; (2) no error accumulation; and (3) the capability of high speed rotation. That of the concave globoidal type in particular is superior in its high operating speed, rigidity, compactness of construction, precision, no uneven loading, and no development of the moment of a couple on the output shaft.

It will be noted from FIG. 17 that the rotary shaft 248 of the transport mechanism 216 is driven through the pulley 305, a pulley 320, endless belt 321, pulley 322, intermittent rotation mechanism 323, and output shaft 326.

In the apparatus constructed as in the foregoing, the tape pieces 11 are heat bonded to the outer surfaces of the open end portions **10*a* of the lower can sections 10** one after another by the following cycle of operation.

The continuous length of tape 210, payed out by the supply reel 211, passes the looper 212 and pinch roll 213 and enters the groove 224 in the tape piece supply roll assembly 214, to be wrapped by suction over the bottom **224*a* of the groove 224. The tape travels in the arrow marked direction with the rotation of the supply roll 218. The supply roll 218 is caused to stop when one of the grooves 234 therein is positioned opposite to the cutter 231, and the tape 210 is cut to a predetermined length. The supply roll 218 is held out of rotation as long as the reduced radius portion 245 of the adhesion roll 221, which is in continuous rotation in the arrow marked direction, is traveling past the position X (the position of the upwardly directed groove 234) on the supply roll 218 where it is opposed to the adhesion roll 221. When the leading end 244*m* of the tape applying portion 244 of the adhesion roll 221 comes to the above position opposite to the supply roll 218, this supply roll is again set into rotation in the arrow marked direction at the same peripheral speed v as the tape applying surface 244*a* of the adhesion roll 221. Thereupon those of the suction ports 223 in the supply roll 218 through which the leading end portion of the tape piece 11 has been sucked thereto communicate with the air chamber 226, so that the leading end portion of this tape piece is smoothly transferred from supply roll 218 to tape applying surface 244*a* by suction exerted thereon through the suction ports 246 in the tape applying portion 244 of the adhesion roll 221. This transfer of the tape piece continues until the groove 234 that has been directed downwardly of the supply roll 218 comes to the position opposite to the adhesion roll 221, whereupon the supply roll 218** is again set out of rotation.

Then the tape piece 11 is released from the suction by the suction ports 246 in the tape applying portion 244 of the adhesion roll 221 at the tape applying station F. The released tape piece 11 is heat bonded, under pressure applied by the coaction of the heat-resistant elastic rubber layer **244*b* of the tape applying portion 244 and the cushion layer 254*b* of one of the mandrels 254, to the entire outer surface of the open end portion 10*a* of one of the lower can sections 10 which is revolving in the arrow marked direction at the peripheral speed v and which is being heated to a temperature at which the tape piece is fusible, as indicated by the dot-and-dash lines in FIG. 16. The thus treated lower can section 10** is subsequently discharged from the apparatus at the delivery station G. In the processing stage the projecting portion 11*a* of the tape is folded inwardly and thermally attached to the edge 10*a*$_1$ and to the inside surface of the open end portion 10*a* of the lower can section for protection. The completed lower can section 10, ready for engagement with the upper can section, is as illustrated in FIGS. 1 and 8.

For heating the open end portions of the lower can sections, a hot air or infrared ray heater might be adopted. However, high frequency induction heating is preferable because of the high heating speed, the uniformity of the heat applied to each can section in its circumferential direction, and the simplicity of the means required. As desired, the roll diameter of the adhesion roll assembly may be increased for the provision of several tape applying portions thereon. Also the supply roll may be increased in diameter so that each tape piece may be wrapped thereon through an angle of, for instance, 90 degrees, instead of 180 degrees in the embodiment of FIG. 13.

In the foregoing disclosure the metal can 1 is made by forming an adhesive layer on the reduced diameter open end portion of the lower can section and by fitting this open end portion of the lower can section in the open end portion of the upper can section. Alternatively the adhesive layer may be formed on the open end portion of the upper can section, after reducing its diameter, and this end portion of the upper can section may be engaged in that of the lower can section. It will also be apparent that the upper and lower can sections can be of any desired shaped within the spirit of the present invention.

INDUSTRIAL APPLICABILITY

The metal can with the annular seam in accordance with the invention is highly proof against corrosion and so can be used for containing foods and like matter. If its upper and lower sections are both seamless, the metal can is capable of resisting high internal pressure, lending itself for use as positive internal pressure containers such as those for carbonated soft drinks, beer, and aerosols.

We claim:

1. A method of making a metal can having an annular seam formed by joining the open end portions of first and second can sections via an adhesive layer, said method comprising the steps of reducing the diameter of the open end portion of the first can section to provide a reduced diameter portion having an outside diameter substantially equal to the inside diameter of the open end portion of the second can section, heat bonding a piece of thermoplastic tape onto the outer surface of the reduced diameter portion of the first can section so as to leave a portion projecting therefrom, folding the projecting portion of the tape substantially radially inwardly of the first can section to cause part of the projecting tape portion to come into contact with the edge of the open end portion of the first can section, further folding the rest of the projecting tape portion into forced contact with the inner surface of the open end portion of the first can section by inserting a mandrel thereinto, causing thermal adhesion of the tape to the edge and inner surface of the open end portion of the first can section by heating the open end portion of the first can section to more than a temperature at which the tape is fusible, while part of the tape is held pressed against the inner surface of the open end portion of the first can section, inserting the reduced diameter portion of the first can section into the open end portion of the second can section, and causing thermal adhesion of that part of the tape which overlies the outer surface of the reduced diameter portion of the first can section to the inner surface of the open end portion of the second can section to form the annular seam by heating at least the open end portion of the second can section.

2. A method as claimed in claim 1, wherein a split tool is provided which has formed therein a first cavity having a cylindrical guide surface in which the open end portion of the second can section can be fitted, an annular shoulder extending radially inwardly from the inner end of the cylindrical guide surface and having a width equal to, or slightly more than, the wall thickness of the open end portion of the second can section, and a second cavity disposed opposite to the first cavity across the annular shoulder in concentric relationship thereto and having a frustoconical guide surface adjoining the annular shoulder and increasing in diameter as it extends away therefrom, and wherein the reduced diameter portion of the first can section, having the thermoplastic tape heat bonded thereto, is inserted into the open end portion of the second can section by fitting the open end portion of the second can section in the first cavity of the split tool into abutment against the annular shoulder therein while the split tool is tightened, by forcing the reduced diameter portion of the first can section into the second cavity of the split tool to cause further reduction of its diameter by the frustoconical guide surface, and by engaging the reduced diameter portion of the first can section in the open end portion of the second can section approximately to the full axial dimension of the reduced diameter portion.

3. A method as claimed in claim 1, wherein a split tool is provided which has formed therein a first cavity having a cylindrical guide surface in which the open end portion of the second can section can be fitted, an annular shoulder extending radially inwardly from the inner end of the cylindrical guide surface and having a width equal to, or slightly more than, the wall thickness of the open end portion of the second can section, and a second cavity disposed opposite to the first cavity across the annular shoulder in concentric relationship thereto and having a frustoconical guide surface adjoining the annular shoulder and increasing in diameter as it extends away therefrom, and wherein the reduced diameter portion of the first can section, having the thermoplastic tape heat bonded thereto, is inserted into the open end portion of the second can section by fitting the open end portion of the second can section in the first cavity of the split tool into abutment against the annular shoulder therein while the split tool is tightened, by forcing the reduced diameter portion of the first can section into the second cavity of the split tool to cause further reduction in its diameter by the frustoconical guide surface, by engaging an edge part of the reduced diameter portion of the first can section in the open end portion of the second can section, and, after loosening the split tool, by inserting the reduced diameter portion of the first can section into the open end portion of the second can section approximately to the full axial dimension of the reduced diameter portion.

4. A method as claimed in claim 1, wherein the open end portion of the first can section, before being reduced in diameter, is approximately equal in outside diameter to the open end portion of the second can section.

5. A method as claimed in claim 1, wherein the first and the second can sections are both seamless ones.

6. Apparatus for the manufacture of a metal can having an annular seam formed by joining the open end portions of first and second can sections via an adhesive layer, said apparatus comprising means for heat bonding a piece of heat-sealable plastic tape onto the outer surface of the open end portion of the first can section so as to leave a portion projecting therefrom, the open end portion of the first can section being reduced in diameter and having an outside diameter substantially equal to the inside diameter of the open end portion of the second can section; means for heat bonding the projecting portion of the plastic tape to the edge and inner surface of the reduced diameter open end portion of the first can section, comprising a die having a first cavity for closely receiving the reduced diameter open end portion of the first can section with the plastic tape heat bonded thereto, an annular shoulder extending radially inwardly from the first cavity and having a width substantially equal to the sum of the wall thickness of the open end portion of the first can section and the thickness of the plastic tape, and a second cavity disposed opposite to the first cavity across the annular shoulder in concentric relationship thereto and having an inside diameter greater than the inside diameter of the open end portion of the first can section, a mandrel to be inserted into and through the second cavity in the die for pressing the projecting portion of the plastic tape against the inner surface of the open end portion of the first can section received in the first cavity in the die, the mandrel having a maximum diameter greater than the remainder of the inside diameter of the open end portion of the first can section minus twice the thickness of the plastic tape, and means for heating the open end portion of the first can section while the projecting portion of the plastic tape is pressed against the inner surface thereof; means for inserting the reduced diameter portion of the first can section, with the plastic tape heat bonded to the outer and inner surfaces and edge thereof, into the open end portion of the second can section; and means for heating the open end portion of the second can section having the reduced diameter portion of the first can section inserted therein, in order to cause heat bonding of that part of the plastic tape which overlies the outer surface of the reduced diameter portion of the first can section to the inner surface of the open end portion of the second can section.

7. Apparatus as claimed in claim 6, wherein the means for heat bonding the plastic tape to the outer surface of the reduced diameter open end portion of the first can section comprises tape piece supply roll means, adhesion roll means having an adhesion roll to be rotated continuously, can section transport means for successively transporting first can sections to a position opposite to the adhesion roll and for holding each first can section in the position opposite to the adhesion roll during the heat bonding of a tape piece thereto, mandrel means to be engaged in the reduced diameter open end portions of the successive first can sections, means for heating the reduced diameter open end portions of the first can sections to a temperature permitting the adhesion of the plastic tape thereto by the time the first can sections reach the position opposite to the adhesion roll, and means for revolving each first can section so that the reduced diameter open end portion thereof rotates at a prescribed peripheral speed during the heat bonding of the plastic tape thereto, the tape piece supply roll means comprising a supply roll having formed therein suction ports for holding by vacuum the plastic tape fed from pay out means and wrapped around the same, a cutter for cutting the plastic tape into successive pieces each having a length approximately equal to the circumference of the reduced diameter open end portion of each first can section, and drive means for the supply roll, the adhesion roll of the adhesion roll means having a tape applying surface of heat-resistant elastic rubber for heat bonding the pieces of plastic tape to the outer surfaces of the reduced diameter open end portions of the successive first can sections in coaction with the mandrel means, the tape applying surface of the adhesion roll having formed therein suction ports for holding by vacuum the successive pieces of plastic tape supplied from the tape piece supply roll means, the tape applying surface of the adhesion roll having a circumferential dimension equal to, or slightly longer than, the length of each piece of plastic tape and having a peripheral speed equal to the peripheral speed of the reduced diameter open end portion of each first can section.

8. Apparatus as claimed in claim 7, wherein the drive means for the supply roll comprises a semiconstant speed cam mechanism for intermittently driving the supply roll in such a manner that the supply roll rotates at the prescribed peripheral speed during the transfer of each piece of plastic tape from the supply roll to the adhesion roll, and that the plastic tape is cut into the required length while the supply roll is out of rotation.

9. Apparatus as claimed in claim 6, wherein the means for inserting the reduced diameter portion of the first can section, with the plastic tape heat bonded thereto, into the open end portion of the second can section comprises a split tool having formed therein a first cavity having a cylindrical guide surface in which the open end portion of the second can section can be fitted, an annular shoulder extending radially inwardly from the inner end of the cylindrical guide surface and having a width equal to, or slightly more than, the wall thickness of the open end portion of the second can section, and a second cavity disposed opposite to the first cavity across the annular shoulder in concentric relationship thereto and having a frustoconical guide surface adjoining the annular shoulder and increasing in diameter as it extends away therefrom.

10. Apparatus as claimed in claim 6, wherein the means for inserting the reduced diameter portion of the first can section, with the plastic tape heat bonded thereto, into the open end portion of the second can section comprises a pair of dies and means for moving the dies toward and away from each other, the pair of dies when closed having a first cavity having a cylindrical guide surface in which the open end portion of the second can section can be fitted, an annular shoulder extending radially inwardly from the cylindrical guide surface and having a width equal to, or slightly more than, the wall thickness of the open end portion of the second can section, and a second cavity having a frustoconical guide surface for guiding the reduced diameter portion of the first can section, the second cavity being disposed opposite to the first cavity across the annular shoulder in concentric relationship thereto and substantially adjoining the annular shoulder and increasing in diameter as it extends away from the annular shoulder, the means for moving the dies toward and away from each other including resilient means for tightening the dies and for holding the same completely closed in the initial stage of the insertion of the reduced diameter portion of the first can section in the open end portion of the second can section, the resilient means having an elastic modulus such that the dies are movable apart from each other against the force of the resilient means from the end of the initial stage to the full insertion of the reduced diameter portion of the first can section in the open end portion of the second can section.

* * * * *